US005592787A

United States Patent [19]

Ophardt

[11] Patent Number: 5,592,787

[45] Date of Patent: Jan. 14, 1997

[54] MODULAR PARTITION SYSTEM

[76] Inventor: Heiner Ophardt, 3931 Vineyard Cres., Vineland, Ontario, Canada, L0R 2C0

[21] Appl. No.: 488,607

[22] Filed: Jun. 8, 1995

[30] Foreign Application Priority Data

May 25, 1995 [CA] Canada ..... 2150174

[51] Int. Cl.[6] ..... A47F 10/00

[52] U.S. Cl. ..... 52/34; 52/36.1; 52/36.5; 52/239

[58] Field of Search ..... 52/34, 36.1, 239, 52/241, 36.5

[56] References Cited

U.S. PATENT DOCUMENTS

| | | | |
|---|---|---|---|
| 2,995,221 | 8/1961 | Sherron . | |
| 3,715,847 | 2/1973 | Straus . | |
| 4,258,511 | 3/1981 | Strain . | |
| 4,475,322 | 10/1984 | Russo et al. . | |
| 4,601,145 | 7/1986 | Wilcox | 52/36.1 X |
| 4,881,353 | 11/1989 | Braendel et al. | 52/239 |
| 5,036,638 | 8/1991 | Kurtz, Jr. . | |
| 5,195,282 | 3/1993 | Campbell . | |
| 5,207,037 | 5/1993 | Giles et al. . | |
| 5,219,406 | 6/1993 | Raz . | |
| 5,363,612 | 11/1994 | Erickson | 52/239 |

FOREIGN PATENT DOCUMENTS

| | | |
|---|---|---|
| 0583527A1 | 2/1994 | European Pat. Off. . |
| 1311348 | 10/1962 | France . |
| 3722849A1 | 8/1988 | Germany . |
| 2030670 | 4/1980 | United Kingdom . |

OTHER PUBLICATIONS

Twincee Advertisment *Extruded Aluminum Frame Partition.*

Twincee Ltd. Partition System Monograph –Published circa Sep. 1994.

*Primary Examiner*—Carl D. Friedman
*Assistant Examiner*—W. Glenn Edwards
*Attorney, Agent, or Firm*—Riches, McKenzie & Herbert

[57] ABSTRACT

A modular partition system which may be used in a cubicle construction for a washroom, change room or shower facility, and which incorporates one or more divider panels suspended in an upright configuration between a pilaster having in its rearward surface a vertical slot and an adjacent surface or wall to form a dividing partition. To conceal the cut edge of the divider panel and provide the partition with a finished appearance, an elongated channel member having front and rear sides with an elongate opening through the rear side is attached to the pilaster. The channel member is secured to the pilaster with its front side in the slot and the cut edge of the panel secured within the channel member opening. The modular construction of the system permits simplified on-side customization and modification for installation in multiple configurations.

22 Claims, 19 Drawing Sheets

D3
A1
70
72
61
78
76
66
68
22a
74b
74a
257
255
13
254
12
64
22b
250
70
250
72
16
254

18
240
102
106
24
54
108
260
181
182
98
116
146
142
100
110
144
244
146
112
144
106
146
224
216
260
204
260

183
158
150
180
184
185
181
239
142
112
140
120
134
132
193
188
118
182
156
186
187
192
12
190
146a
110
12'
13
146
162a
116
13'
144
148
128
160
126
149
166
162b
164
146
168
A2
d1
100

FIG.17.
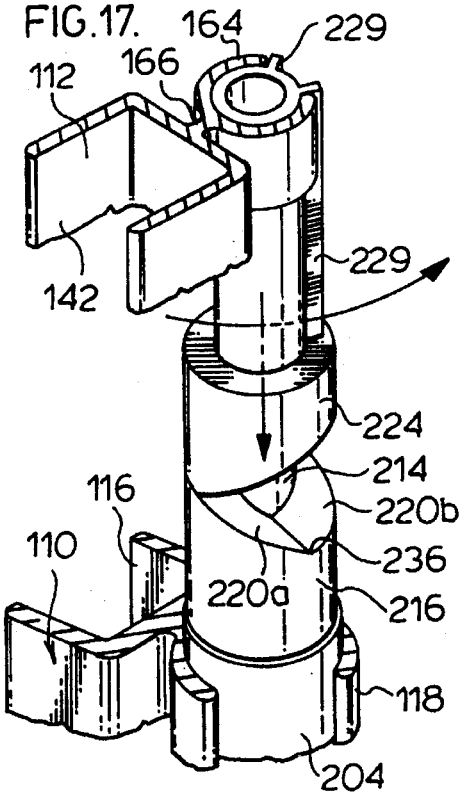
FIG.16.
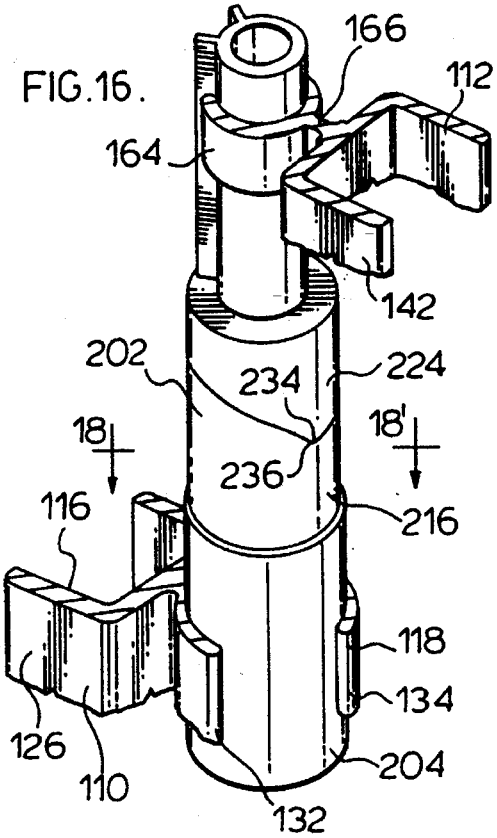
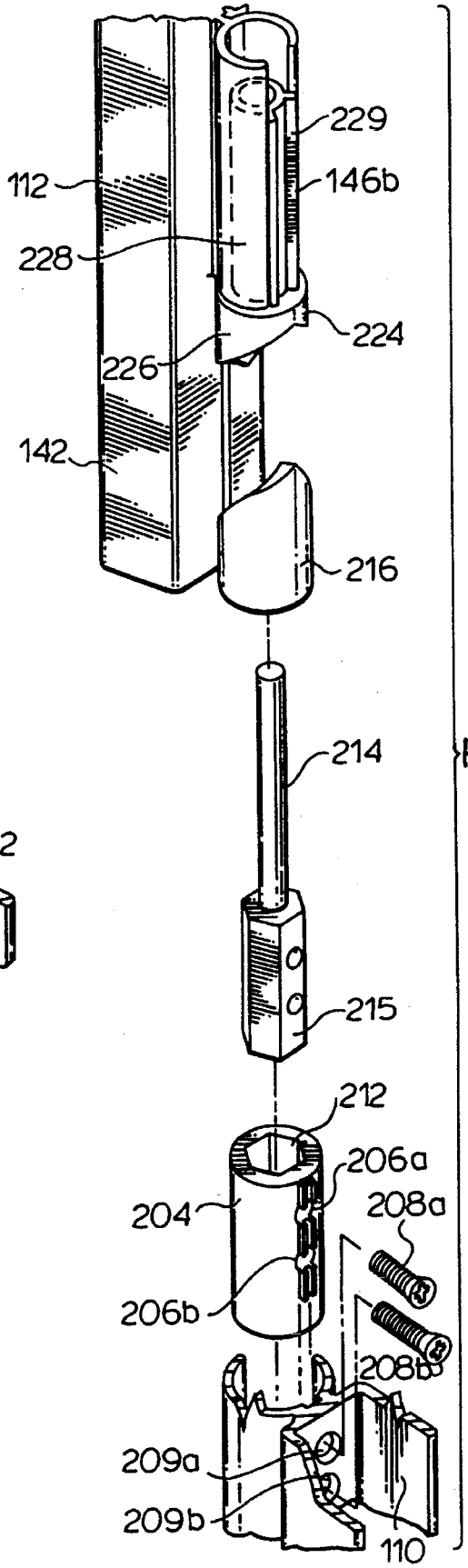
FIG.15.

MODULAR PARTITION SYSTEM

SCOPE OF THE INVENTION

The present invention relates to a modular partition system which may be used in a cubicle construction for a washroom, change room or shower facility, and more particularly to a system which permits simplified on-site customization and modification for installation in either a floor anchored/overhead braced, floor mounted or ceiling hung configuration without requiring preordering and sizing of the partition pilasters, doors, divider panels and hinges.

BACKGROUND OF THE INVENTION

It is known to provide privacy cubicles and partitions in public washrooms and change rooms. Conventional partition assemblies or systems usually have as their principal components all metal pillars or pilasters which are the vertical supports which function as the load carrying frame, as well as metal doors and divider panels. The cubicles and partitions are most frequently erected adjacent walls and room corners with the adjacent walls supporting various partition components as well as functioning as a side and/or the ends of the cubicles. The all metal construction of the partition components is disadvantageous in that to install conventional partition assemblies, it is necessary to premeasure and custom order the components of each partition assembly to precisely fit each separate installation. The necessity of premeasuring and ordering the components increases both the time and cost of installation of the partitions.

Conventional partition assemblies suffer a further disadvantage in that the metal components cannot readily be modified or trimmed to size once they have been manufactured. As such, miscalculations in measuring the installation site or changes in site dimensions with the finishing of wall tile, dry wall, countertops or the like may result in a preordered partition assembly which is too large or small to be installed at the intended site.

Conventional partition systems further incorporate a number of specialized parts for use in their erection. Typically different attaching members are used to attach partition divider panels to the pilasters, from those used to attach the divider panels to the wall. The requirement of increased numbers of specialized components makes the assembly of the divider systems more complex as well as increasing material costs.

Another difficulty with conventional divider systems exists in that the hinges which are used to attach the cubicle door frequently connect the door in such a manner that large gaps exist between the vertical edges of the door and the adjacent pilasters. These gaps deprive the user of the privacy which is intended by the partition system.

SUMMARY OF THE INVENTION

Accordingly, it is an object of the present invention to overcome the disadvantages of the prior art by providing a partition system which is easily adaptable for installation in almost any configuration and which may be custom sized on site to form cubicles and/or divider panels of almost any size.

Another object is to provide a partition system in which modular pillar or pilaster members are provided which enable the erection of a partition system having any number of cubicles or stalls.

Another object is to provide a cubicle assembly in which the widths of the cubicles and/or the cubicle doors may be quickly and easily customized on-site.

Another object is to provide a partition structure in which modular channel members are used to support the edges of the divider panels against either a pilaster or a wall, and in which the supported panel edges are concealed to provide the partition system with an aesthetically pleasing overall appearance.

A further object of the invention is to provide an improved hinge structure which pivotally secures a door to an adjacent surface without leaving a gap between the hingely coupled edge of the door and the adjacent surface.

A further object of the invention is to provide a partition system which may be readily customized to suit any of a number of decors easily and inexpensively.

Another object of the invention is to provide a modular partition system in which the same principal components may be assembled in either a floor anchored/overhead braced, floor mounted or ceiling hung configuration without the need of first preordering and sizing.

The inventor has appreciated that by providing a partition system having modular standard sized pilasters or pillars (hereinafter collectively referred to as pilasters), divider panels which may be cut to a desired length and modular channel members for supporting the divider panels in an installed configuration with the cut portions concealed, a highly adaptable partition system may be obtained.

In its simplest form, the partition system may incorporate a single divider panel which in assembly is suspended in an upright configuration between a pilaster and an adjacent surface or wall to form a dividing partition, as for example may be used to separate two urinals in a washroom. The pilaster includes in its rearward surface a slot which orients vertically when the pilaster is installed. The pilaster is erected the desired distance from the wall, and the divider panel is cut along one edge to length to fit between the wall and pilaster. To conceal the cut edge of the divider panel and provide the partition with a finished appearance, an elongated channel member having front and rear sides with an elongate opening through the rear side is attached to the pilaster. The channel member is coupled to the pilaster with its front side in the slot and the cut edge of the panel is secured within the channel member opening with the panel extending rearwardly therefrom. Alternately, two channel members may be used, one secured to the pilaster and the other spaced therefrom and coupled to the wall or other surface so that the elongate openings align and open towards each other to support a respective vertical edge of a divider panel therein.

The modular nature of the components also permits their use in a kit for the erection of multiple cubicle partitions or other partition structures. Although not essential, two types of pilasters may be provided, each having a predetermined width; i.e. of a standard 6" width for run pilasters which are used to link adjacent cubicles; and a standard 4" width for corner pilasters which are used at the outside front corners of each partition structure. The larger run pilasters may be symmetrical about their vertical centers so as to provide identical edge portions for the attachment of hinges or door stops and the like on either side. The corner pilasters have one edge portion which is identical to the edge portions of the run pilasters to which hinges or door stops may be secured, and an opposite rounded edge portion to provide the partition structure with a softer finished appearance.

By using modular pilasters, a partition assembly may be erected either as a free standing structure or against one or more walls, having any number of cubicles with the doorway into each cubicle defined by adjacent spaced pilasters. Preferably the cubicle doors are also formed from materials which may be cut on-site, permitting the spacing of adjacent pilasters to be varied to form doorways of any desired width. The hinge assembly used to connect the door to the remainder of the partition may also be configured to conceal the cut edge of the panel, providing the partition structure with a finished appearance.

Adjustments to customize the partition system to different sizes of rooms and configurations may easily be made by simply cutting the doors and/or divider panels to desired widths on a portable table saw, circular saw or the like. The doors and/or divider panels may be selected from a number of materials including: marble, stone, laminates, wood, particle board, fiberglass and plastics.

More preferably, the pilasters are provided with a front opening channel or guide-way which is sized to receive therein a removable decorative panel insert. In assembly, a panel insert having the desired finish is inserted into the pilaster guide-way and positioned rearward of the front opening so as to be visible therethrough. The opening is preferably large enough so that colour selection of the pilasters may readily be achieved simply by selecting and inserting into the guide-way a panel insert having the desired colour. Suitable panel inserts would therefore include any panel with a decorative appearance including natural wood panels, laminates, plastics or even panels made from marble, stone or other natural materials. The panel inserts, doors and divider panels may therefore be easily colour coordinated without having to preorder the desired colour, or having to paint the partition system after it is installed.

In addition to their use for supporting and concealing the edges of the divider panels, the channel members provide added support to the pilasters, increasing the overall structural integrity of the partition system. The front side of the channel members and the slots of the pilasters preferably have interlocking complementary shapes selected to permit the sliding insertion of the front side of the channel member into an associated pilaster slot for fixing the pilaster and slot together. The interlocking of the front side of a channel member in the slot permits longitudinal sliding relative thereto, while preventing lateral movement of the channel member relative to the pilaster whereby the pilaster and channel member may be separated. The channel members may, for example, have either a generally rectangular or square cross-sectional C-shape, with flanges extending from edges of the front side to couple a channel member to associated T-shaped slot formed in the rearward surface of a pilaster.

While conventional hinges may be used to attach the cubicle doors, it is more preferable that the hinge assembly is elongated and covers the entire vertical edge of a door panel to which it is attached. The hinge assembly may also in itself be of a modular construction enabling it to be cut to the vertical length of any door edge to which it is to be attached.

More preferably, the hinge assembly is formed as a continuous hinge extending as a substantially continuous unit between the door panel and an adjacent surface such as a pilaster or door jamb to substantially eliminate any gap therebetween.

The continuous hinge includes two hinge arm members which are pivotable relative to each other and are attached to a respective one of the door panel and the adjacent surface. The first hinge arm includes a generally cylindrical open channel which in cross-section defines an arc of a circle extending radially about an axis between about 200° and 340°, and more preferably about 260°±20°, and a first U-shaped channel portion for coupling over one of a door edge or door jamb.

The second hinge arm preferably includes one or more modular bearing members having a generally cylindrical shape and size which permits their rotatable insertion axially into the open channel while preventing movement radially outwardly therefrom, and a second U-shaped channel portion for coupling over the other of the door and the door jamb. Clips, prongs or other suitable joining apparatus are provided along the second U-shaped channel portion to couple the cylindrical bearing members to the second U-shaped channel portion. The insertion of the cylindrical bearing members into the open channel pivotally couples the first and second hinge arms together with the clips or other joining apparatus extending radially outwardly through an open side of the open channel. With the hinge arms so connected, the relative rotational movement of the bearing members and the open cylindrical channel thereby pivots the second hinge arm relative the first hinge arm.

When the door is moved to a fully closed position, an edge of the open channel and the second arm portion more relatively to a position where the open channel edge abuts the second U-shaped channel portion to substantially eliminate any gap therebetween.

Accordingly in one of its aspects, the present invention resides in a modular washroom partition construction comprising vertical post means and planar divider panel means, the post means comprising a vertical pilaster means and an elongate support channel member, the channel member having a front and a rear with an elongate opening in its rear extending the length of channel member, the pilaster means having on its rearward surface vertically extending slot means, means to locate the channel member longitudinally relative the channel member, wherein the pilaster means and channel member are coupled together with the front of the channel member received in the slot means for longitudinal relative sliding, and the planar divider panel means having a forward vertical edge portion, and being coupled to the channel member extending rearwardly from the post means with the vertical edge portion secured within the opening of the channel member.

In another aspect, the present invention resides in a modular partition construction comprising;

first and second vertical post means, said first post means spaced from said second post means and defining a door opening for a first cubicle therebetween, door means pivotally disposed in said door opening, the door means including a door panel and hinge means for hingely coupling said door panel to one of said first and second post means, planar divider panel means having a forward vertical edge portion and a rearward vertical edge portion for defining a first side of said first cubicle, and a plurality of elongate support channel members each being elongated along a longitudinal axis and in cross-section through said axis having a generally rectangular C-shape with parallel spaced front and rear sides, said rear side defining an opening therethrough extending the length on said channel member parallel to said axis, said opening having a dimension sized to receive therein one edge portion of said divider panel means, said first post means comprising first pilaster means and a first one of said channel members, said first pilaster means having a forward and rearward facing vertical surfaces, and slot means for engaging said first channel member extending vertically along said rearward surface, the slot means and front side of the channel member configured to permit the front side of the channel member to be slid into the slot means so that the first channel member and first pilaster means are fixed to each other for relative longitudinal sliding, wherein in assembly, said first channel member is coupled to said first pilaster member with said front side disposed in said slot means, the first vertical edge portion of said divider panel means is secured in said first channel member opening, and the second vertical edge portion of the panel means is secured in the opening of a second one of said channel members which is spaced from said first channel member.

In another aspect, the present invention resides in a modular partition structure comprising;

at least one planar divider panel, each panel having generally parallel spaced vertical panel edges, at least one vertical pilaster member having forward and rearward facing vertical surfaces, a pair of vertically extending side portions joining the forward and rearward surfaces, and a T-shaped slot integrally formed in the rearward surface, a plurality of channel members each being elongated along a longitudinal axis and in cross-section through said axis having a generally square C-shape with parallel spaced front and rear sides, the front side having a complementary shape to said T-shaped slot for sliding insertion therein and the rear side defining an opening therethrough extending the length of the channel member parallel to said axis, the channel member opening sized to receive the vertical edges of a divider panel therein, the T-shaped slot and front side of the channel members having dimensions selected to permit longitudinal sliding of the front side of an associated channel member in the slot while fixedly coupling the associated channel member to the pilaster against removal laterally therefrom, a first one of said channel members being coupled to an associated first pilaster member with its front side inserted in the first pilaster slot, a second one of said channel members secured to a wall in a position spaced from said first channel member, and a first one of said divider panels defining a first partition wall being coupled in an upright position with a first one of the panel edges concealed within said first channel member opening, and the second other one of the panel edges concealed second channel member opening.

In a further aspect, the present invention resides in a continuous hinge for pivotally attaching a door to a door jamb, said hinge comprising, a first arm member and a second arm member movable relative to said first arm member, said first arm member having first coupling means for coupling said first arm member to a first one of said door and said door jamb, and an open channel means for rotatably receiving therein a portion of said second arm member, the open channel means being elongated along a central axis and in cross-section through said axis said channel means extending from a first channel edge to a second channel edge to define an arc of a circle centered on said axis which is greater than 240° and less than 325°, with said first and second channel edges defining a channel opening therebetween, said second arm member including second coupling means for coupling said second arm member to the second other one of said door and said door jamb, at least one modular generally cylindrical bearing member adapted to be rotatably received in said open channel means, and joining means for connecting said at least one cylindrical bearing member and said second coupling means, each said bearing member having a diameter selected to permit its insertion axially into said open channel means while preventing its withdrawal radially outwardly therefrom between the first and second channel edges, and stop means for engaging said second arm member and limiting axial movement of said at least one bearing member in said open channel means, wherein when said at least one bearing member is coupled to the second coupling means by the joining means and axially inserted into said open channel means, the joining means extends radially outwardly from the open channel means through said channel opening, and on rotational movement of the at least one bearing member relative to the open channel means, the joining means pivots about the axis relative to said first arm member between said first and second channel edges.

In another aspect, the present invention resides in a hinge for pivotally connecting a door to an adjacent surface, said hinge comprising a first elongate arm member and a second elongate arm member movable relative to each other.

The first arm member including, a rectangular U-shaped channel member for placement over a first one of a door edge and an adjacent surface coupling the first arm member thereto, and an open cylindrical channel member for rotatably receiving therein a portion of the second arm member, the channel member elongated along a central axis and in cross section through said axis having a round C-shape extending from a first channel edge along an arc of a circle about 260° centered on the axis to a second channel edge, the second arm member including a second rectangular U-shaped channel member for placement over the second other one of the door edge and the adjacent surface coupling the second arm member thereto, a generally cylindrical bearing member for rotatable insertion into the channel member, the bearing member having a diameter selected to permit its insertion axially in the channel member while preventing its removal radially therefrom between the first and second channel edges, and a plurality of clip members projecting from the second channel member, the clip members each including a planar web portion extending longitudinally along the second channel member and a gripping portion for fixedly coupling the bearing member thereto, and stop means for engaging said second arm member and limiting axial movement of the bearing member in the cylindrical channel member, whereby when the bearing member is coupled to the clip members and inserted into the channel member, the web portions extend radially from the channel member between the first and second channel edges, whereby rotational movement of the bearing member relative to the channel member pivots the clip member and second channel member about the axis relative to the first arm member moving the web portions along an arcuate path between the first and second channel edges.

BRIEF DESCRIPTION OF THE DRAWINGS

Further aspects and advantages of the present invention will appear from the following description taken together with the accompanying drawings in which:

FIG. 15 shows a partially cut-away exploded view of the biasing assembly and hinge arms of FIG. 9;

FIG. 16 shows the biasing assembly of FIG. 15 with the hinge arms moved to an unbiased rest position;

FIG. 17 shows the biasing assembly of FIG. 15 with the hinge arm moved to a biased fully open position;

DETAILED DESCRIPTION OF THE PREFERRED EMBODIMENTS

Figure 1:
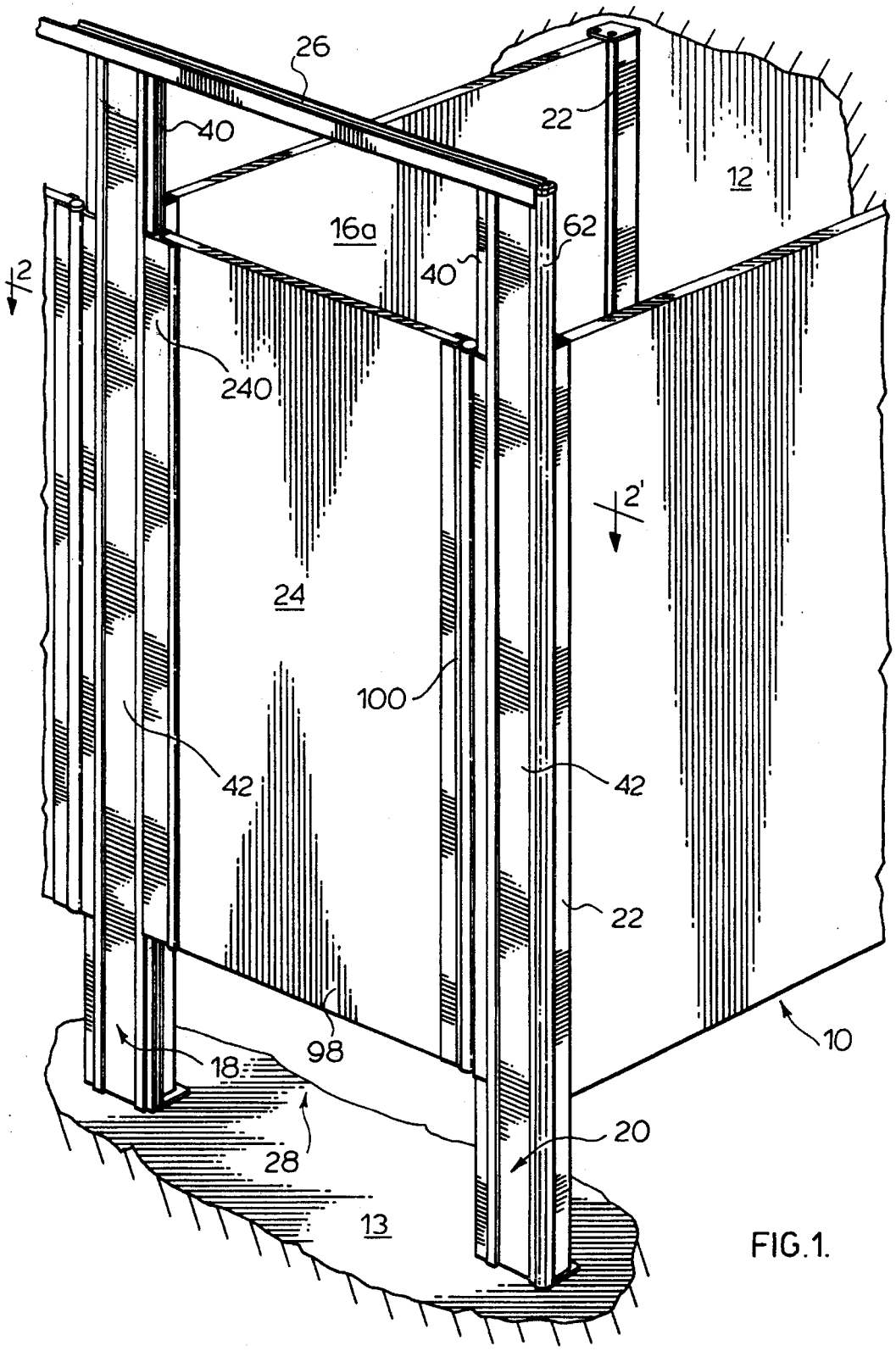
FIG. 1 is a partial perspective view of a partition construction in accordance with the first embodiment of the present invention.
Figure 2:
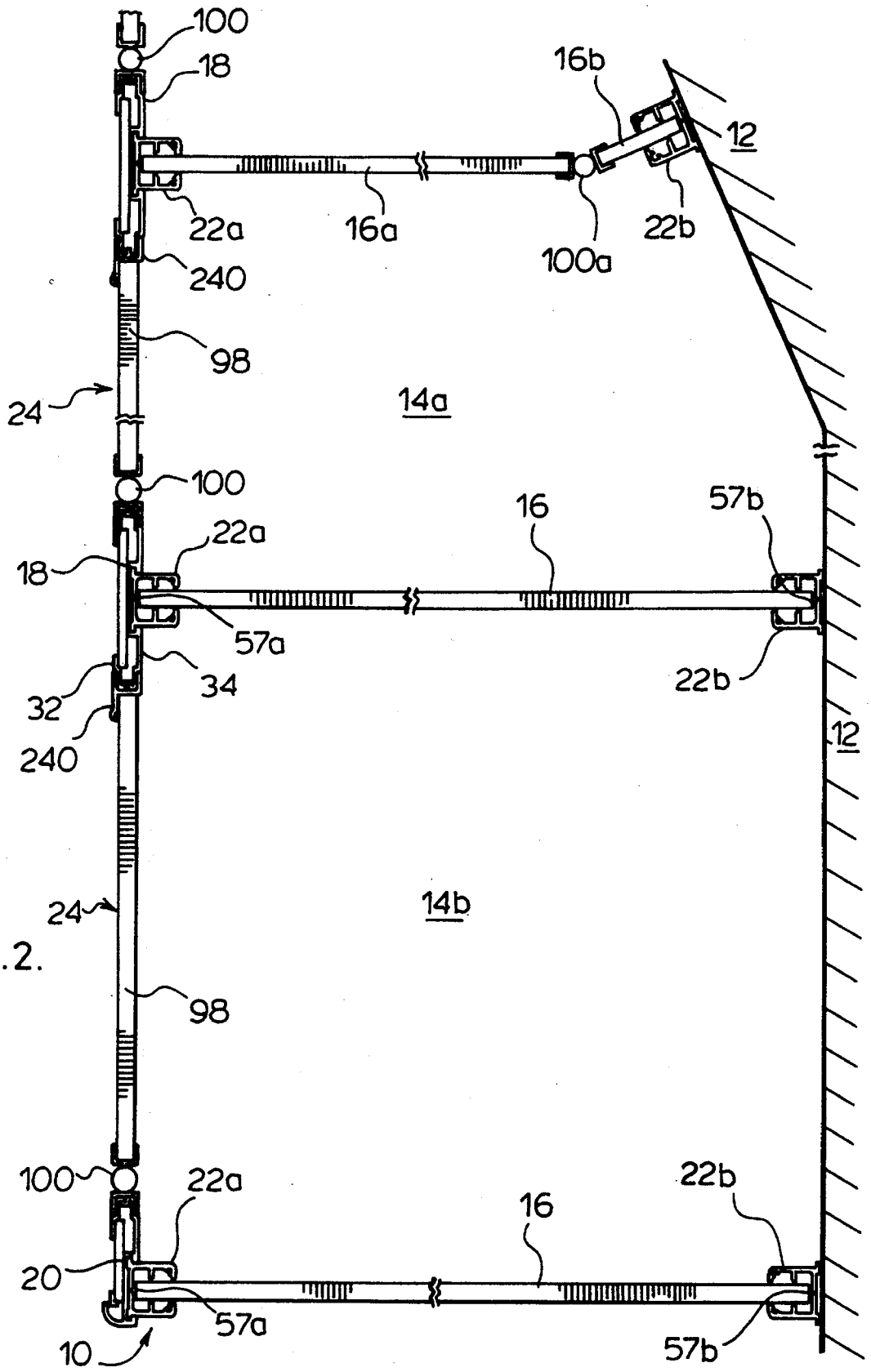
FIG. 2 is a cross-sectional view of the partition construction shown in FIG. 1 taken along lines 2–2'.

Reference is now made to FIGS. 1 and 2 which show a preferred modular partition structure 10 which has been erected against a building wall 12 to form a number of individual toilet stalls or cubicles 14 for a public washroom. The wall 12 serves as a rear end of each cubicle 14 and eliminates the need for a partition backwall. If desired, the partition structure 10 could equally be positioned away from the wall 12 or adjacent a wall corner with the second wall serving as a side of an endmost cubicle. Two partial cubicles **14*a*,14*b* are shown for clarity, however the partition structure 10 is such that any number and almost any size of cubicles 14** could be assembled together.

The partition structure 10 is preferably in the form of a kit which includes as principal components: planar divider panels 16 which serve as the sides for each cubicle 14; vertically extending pilasters 18,20 which provide vertical support to the partition structure 10 and act as the principal load carrying frame; rigid channel members 22 for supporting the edges of the panels 16 and/or the pilasters 18,20 to provide additional structural integrity to the partition structure 10; and a door assembly 24 for each cubicle 14. The principal components of the partition structure 10 are formed from materials which may be modified by portable saws and the like, to permit their simplified on-site assembly and customization, eliminating the need to first premeasure the installation site and custom order a partition structure which has been pre-engineered.

The partition structure 10 shown in FIG. 1 is of a floor anchored/overhead braced configuration in which the pilasters 18,20 extend from the floor 13 upwardly above the upper edges of the divider panels 16 and door assemblies 24 where they are connected by an extruded aluminum overhead cross-brace 26. As will be described in greater detail hereafter, the modular construction of the pilasters 18,20 and channel members 22 equally permit the assembly of a partition structure 10 in a floor mounted or a ceiling hung configuration, providing the structure 10 with a very high degree of adaptability.

A. Pilasters

In the partition structure 10, a number of elongated pilasters 18,20 between 2 and 2.5 meters in length are vertically positioned between two and four feet apart an equal distance outwardly from the wall 12. The pilasters 18,20 shown best in FIGS. 3 and 5 to 8 each include forward and rearward facing vertical surfaces 32,34, which are joined along vertically extending side portions 36,38. The pilasters 18,20 are positioned from the wall 12 in alignment so that the rearward surfaces 34 face the wall 12 and their forward facing surfaces 32 form the front of each cubicle 14, with immediately adjacent pilasters 18,20 defining a door opening 28 into each cubicle 14 therebetween.

To provide the partition structure 10 with an aesthetically pleasing finished appearance, two types of pilasters are provided, one a run pilaster 18 which is used to link adjacent cubicles **14*a*,14*b* and the second a corner pilaster 20 used at each end of the partition structure 10. While two run pilasters 18 and one corner pilaster 20 are shown, it is to be appreciated that a second corner pilaster may be positioned at the other opposite end of the partition structure 10; and the number of run pilasters 18 to be used will correspond to the number of pairs of adjacent cubicles 14** to be erected.

Figure 3:
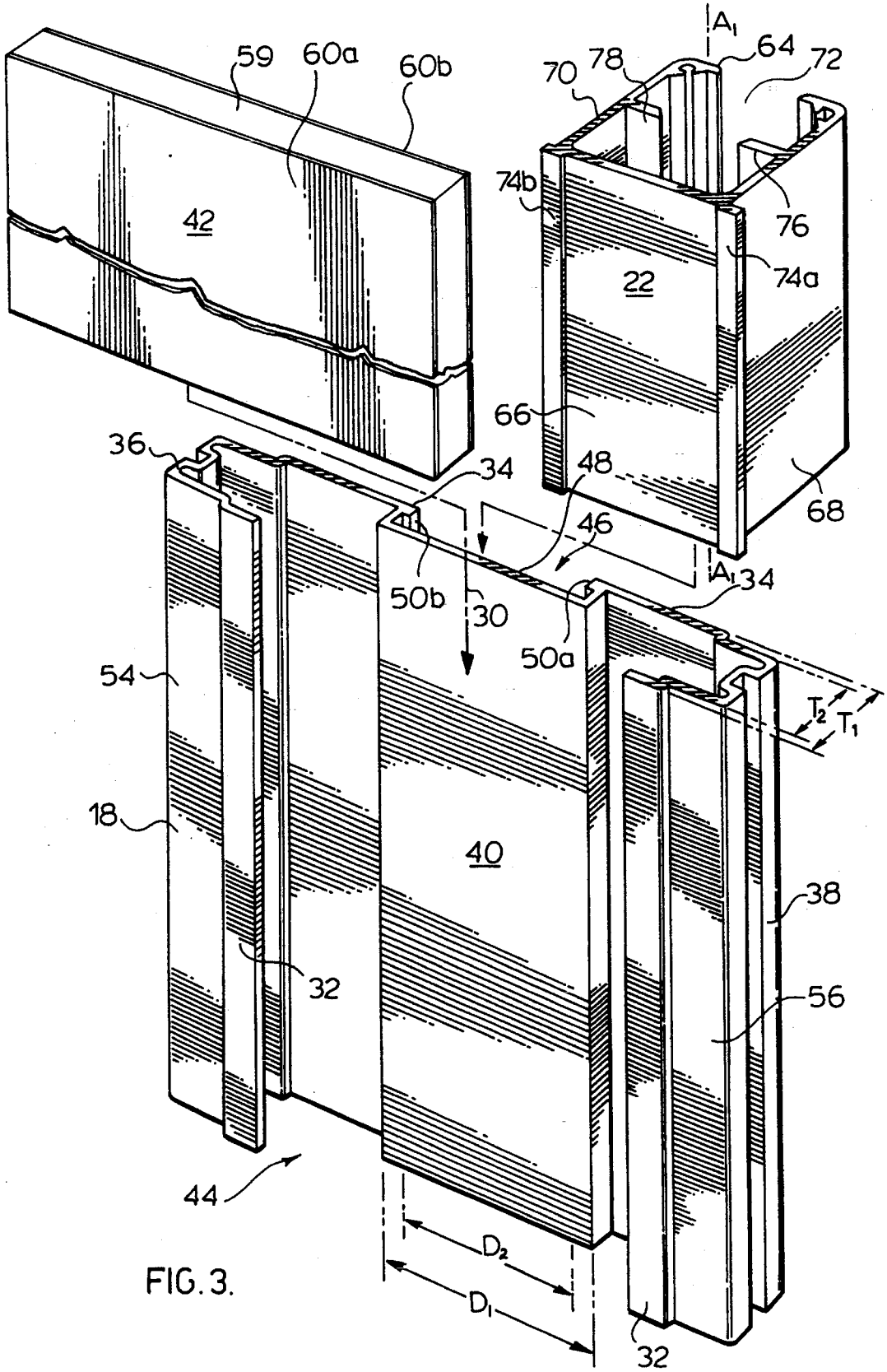
FIG. 3 is an exploded partial view of a pilaster, a pilaster insert, and channel member for use in the partition construction of FIG. 1.

FIG. 3 shows best an exploded view of a run pilaster 18 having a width of about 15 cm and which is symmetrical about a centrally located vertical plane which extends normal from the middle of the forward surface 32 to the rearward surface 34. The run pilaster 18 is essentially of a two part construction and includes an extruded aluminum shell 40 and a decorative panel insert 42.

Figure 8:
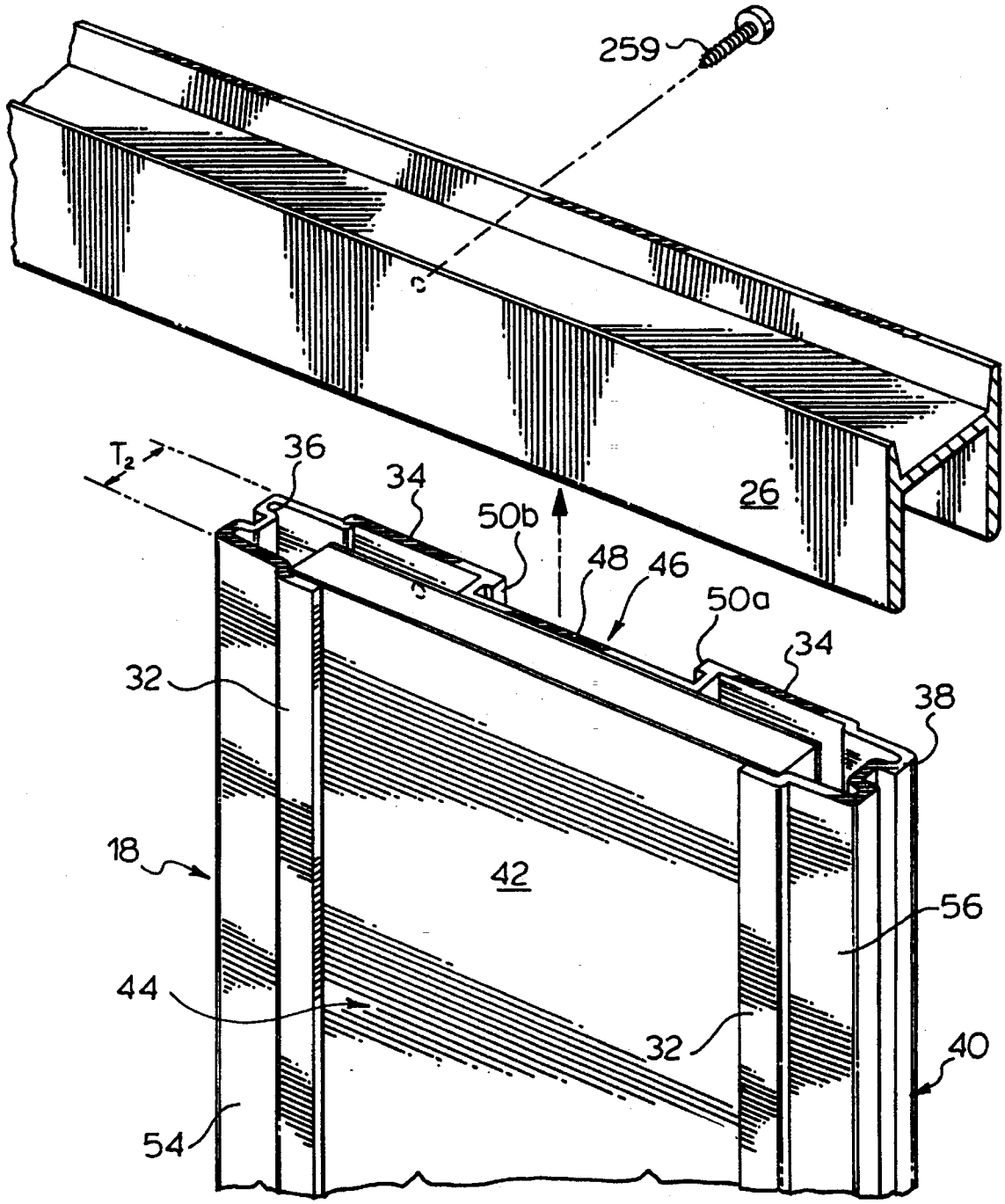
FIG. 8 is an exploded view of the run pilaster and overhead brace shown in FIG. 1.

As seen best in FIGS. 3 and 8, the pilaster shell 40 acts as a guide-way into which the insert 42 may be vertically slid. The shell 40 is formed as a continuous web which defines the rearward pilaster surface 34, each side portion 36,38 and the forward surface 32. In horizontal cross-section, the shell 40 has a generally rectangular C-shape opening to a vertically extending front opening 44 in the forward pilaster surface 32.

A flat T-shaped slot 46 is integrally formed in the center of the rearward surface 34. The slot 46 extends vertically along the entire length of the pilaster 18, and includes a flat generally rectangular innermost end 48 and a pair of outwardly spaced shoulder portions **50*a*,50*b*. The innermost end 48 has a width which extends in the horizontal direction a distance $D_1$. The shoulder portions 50*a*,50*b*, each overlap a respective peripheral vertical edge portion of the innermost end 48** and are separated from each other by a distance $D_2$, defining a parallel sided gap therebetween.

The pilaster 18 has an overall thickness in a front-to-rear direction between the forward and rearward surfaces 32,34 of a predetermined dimension $T_1$. Towards each respective side portion 36,38, the shell 40 narrows to define a vertically extending narrower edge portion 54,56. The narrower edge portions 54,56 are generally square in horizontal cross-section and each have an overall thickness in the front-to-rear direction of a dimension $T_2$ selected slightly less than thickness $T_1$.

The panel insert 42 has a length selected to extend the entire vertical length of the pilaster 18 and in assembly, is slid into the shell 40 in the direction of arrow 30 between the forward and rearward surfaces 32,34 to a position immediately rearward of the front opening 44. Once so positioned, the central portion of the insert 42 is visible through the opening 44 with any cut vertical edges of the insert 42 remaining concealed. The panel insert 42 preferably has a thickness between 1.0 and 3.0 cm, and may for example be formed from materials used to produce standard kitchen counter-tops or the like. The thickness of the insert 42 is preferably selected so that it is held in place within the shell 40 in a friction fit, whereby the insert 42 is engaged on part of each of its sides by the portions of the shell 40 which form the slot end 48, the narrower edge portions 54,56 and the forward surface 32.

The panel insert 42 is formed from a particle board core 59 which is laminated on one, and preferably each side with a coloured vinyl overlay **60*a*,60*b*. To provide the pilaster 18 with the greatest flexibility for on-site customization, the vinyl overlays 60*a*,60*b* on each side of the core 59 are of different colours, and/or patterns enabling the same inserts 42** to be used to produce different coloured pilasters.

Figure 6:
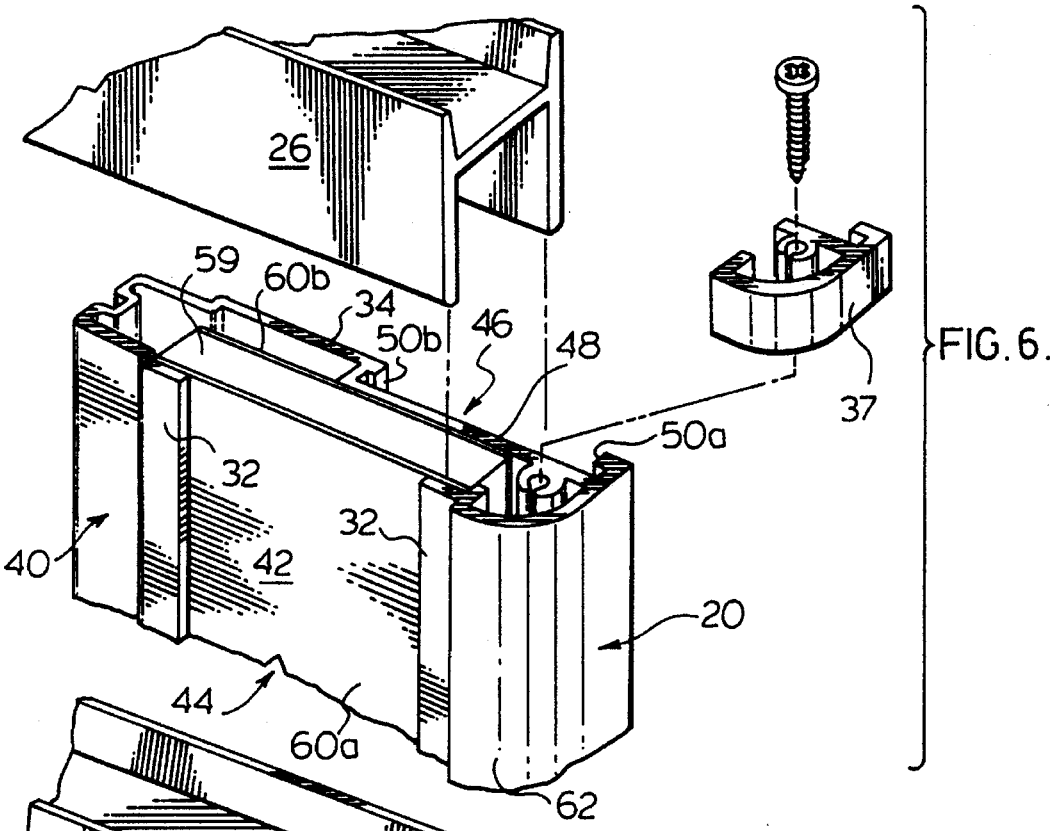
FIG. 6 is an exploded view of the upper portion of the right hand corner pilaster and overhead brace of FIG. 1.
Figure 7:
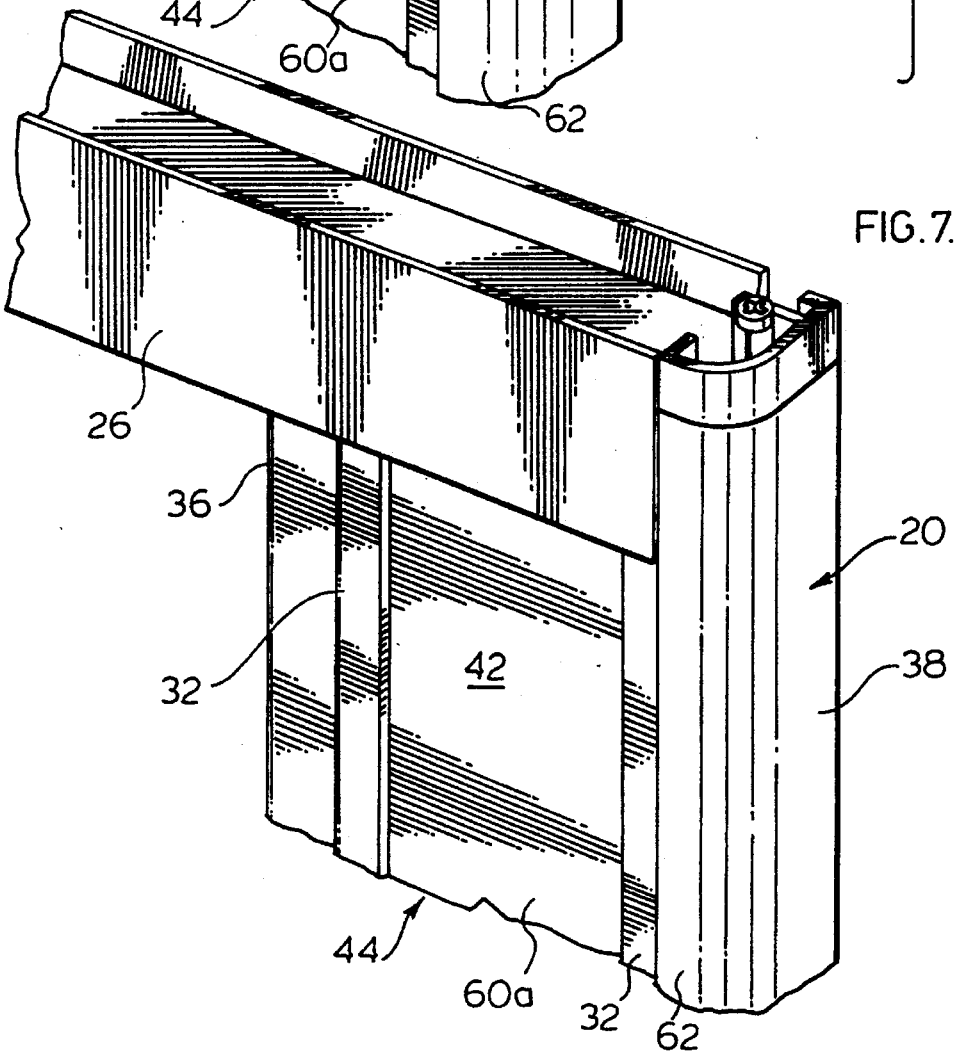
FIG. 7 shows a partial perspective front view of the assembled corner pilaster and overhead brace of FIG. 6.

FIGS. 6 and 7 show best a corner pilaster 20 which, with the exception of side portion 38 and a narrower overall width of approximately 10.5 cm, is identical to the run pilaster 18 with like reference numerals identifying like components. Like the run pilaster 18, the end pilaster 20 is of an essentially two part structure having a shell 40 having a front opening 44 and a panel insert 42 sized for sliding insertion into the shell 40 in a friction fit so as to be visible through front opening 44. The principal difference between the corner and run pilasters 18,20 is that in place of a narrower edge portion 56, the side portion 38 of the corner pilaster 20 is formed as a rounded corner edge 62 extending forwardly from the edge of the shoulder portion **50*a* partially along an arc to the forward surface 32. When positioned in place at each end of the partition structure 10, the corner pilaster 20 provides the structure 10** with a softer more aesthetically pleasing look.

The use of extruded aluminum and particle board for the respective pilaster shells 40 enable the shells 40 to be cut on-site to a desired length and width by a portable saw or the like. Similarly by forming each insert 42 from laminated particle board, the inserts for each pilaster 18 may be cut from a single larger laminate sheet to the required width and length to minimize waste.

B. Divider Panels

FIG. 2 shows two rectangular divider panels 16 of the partition structure 10, each having a height of between 1.5 and 2 meters and a length extending between the wall 12 and a corresponding pilaster 18,20 of roughly 2 meters. The divider panels 16 are secured in position in a vertically upright position extending rearwardly from an associated pilaster 18,20 to the wall 12. The divider panel **16*a* which extends between the run pilaster 18 and wall 12 forms a common side of the adjacent cubicles 14*a*,14*b*. The divider panel 16*b* extending between the corner pilaster 20 and the wall 12 forms the second other side of the cubicle 14*b* and an end side of the partition structure 10**.

The divider panels 16 consist of planar sheets of particle board which is laminated on each side with vinyl, and preferably have finished top and bottom edges. The panels 16 may be a standard ½", but are more preferably ¾" thick and have an overall thickness equal to the thickness $T_2$, of the narrower edge portions 54,56 of the pilasters. In addition to providing an inexpensive panel material, the use of laminated particle board for the divider panels 16 advantageously enables the panels 16 to be easily cut along their vertical edges **57*a*,57*b*** to any desired length.

While FIGS. 1 and 2 show a partition structure 10 with two divider panels **16*a*,16*b*, it is to be appreciated that additional divider panels are to be provided as may be required to separate adjacent cubicles 14 and/or form a second other end of the partition structure 10**.

C. Channel Members

The partition structure 10 includes a number of extruded aluminum channel members 22 for supporting the divider panels 16 in a vertically upright position and/or providing additional structural support to the pilasters 18,20.

Figure 4:
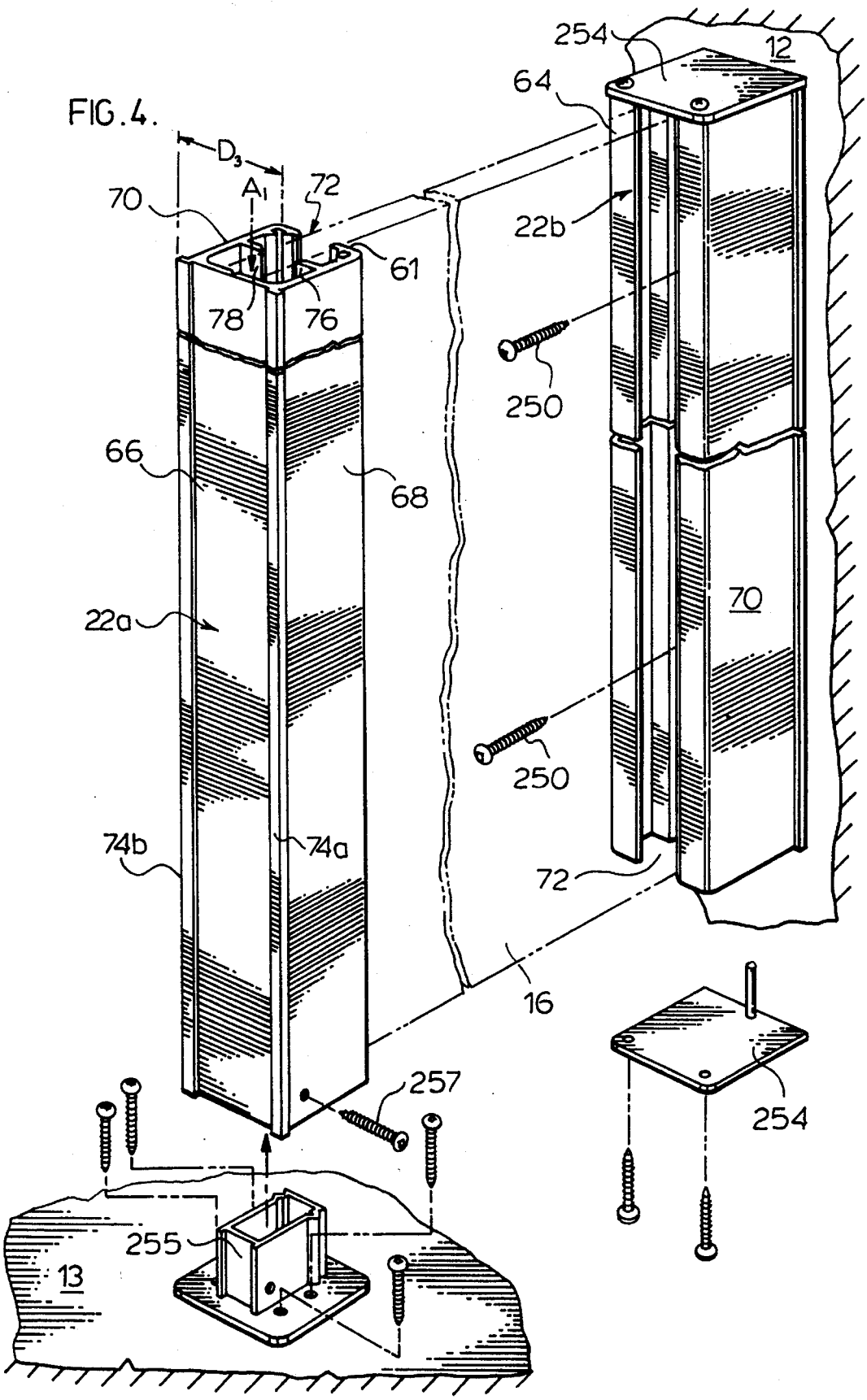
FIG. 4 shows a partial schematic view of two panel supporting channel members of FIG. 1 in a floor mounted and wall mounted configuration.
Figure 5:
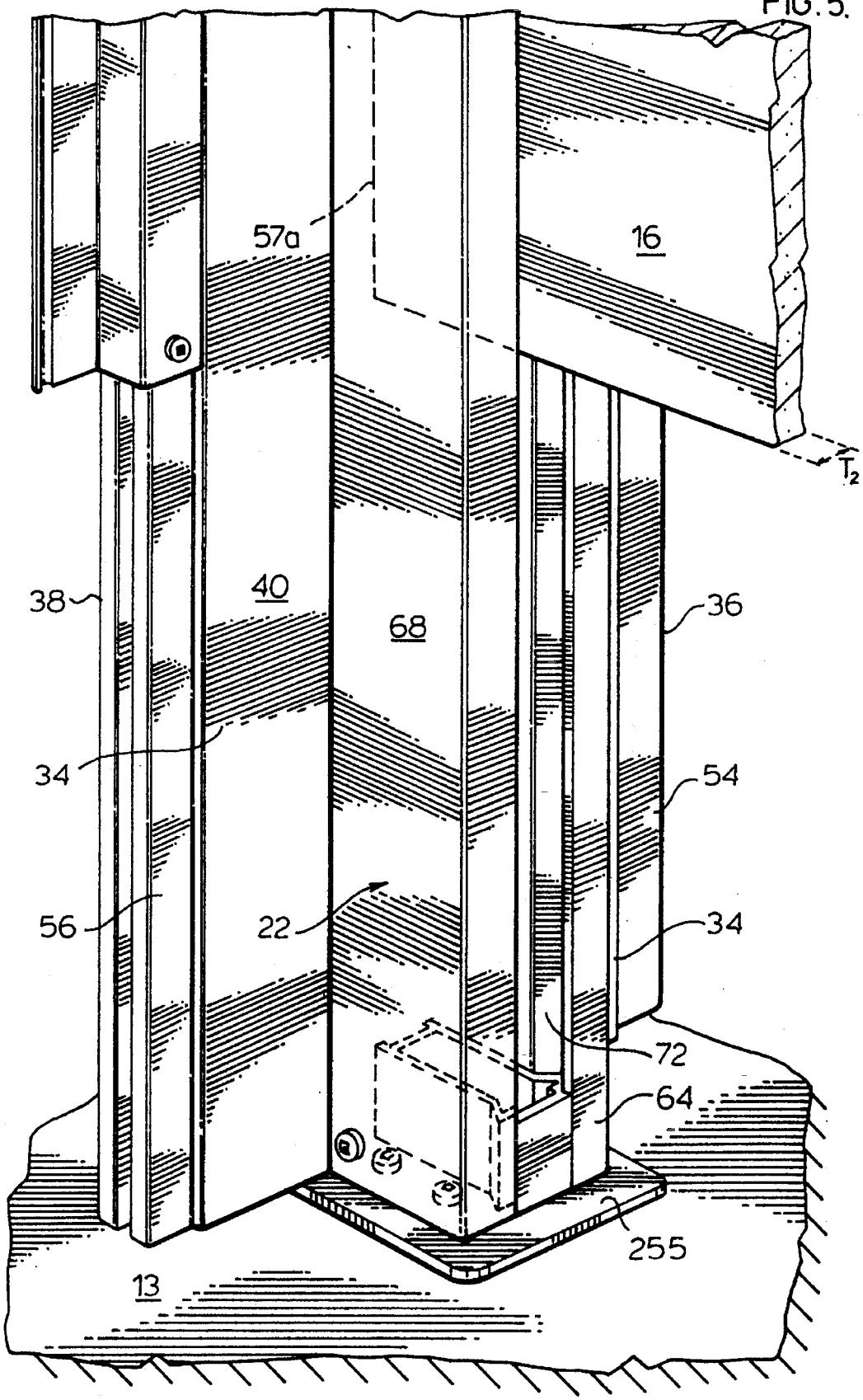
FIG. 5 shows a schematic rear view of the central run pilaster, channel member and divider panel used in the construction shown in FIG. 1 with the door open.

FIGS. 3 and 4 show best the channel members 22 as each being elongated along a longitudinal axis $A_1$. In cross-section through the axis $A_1$, the channel members 22 have a generally square C-shape with parallel spaced front and rear sides 66,64, and parallel spaced lateral sides 68,70 extending perpendicularly from each longitudinal edge of the rear side 64 to join the front side 66.

The rear side 64 of the channel member 22 defines an elongated rectangular opening 72 therethrough, which extends through a central portion of the rear side 64 along the length of the channel member 22, parallel to the axis $A_1$. The opening 72 has a lateral width slightly larger than the thickness of the divider panel 16. More preferably the opening is slightly larger than the thickness $T_2$ of the narrower edge portions 54,56 to permit insertion of an edge portion 57 of either a divider panel 16 or edge portions 54,56 therethrough.

A pair of longitudinally extending flanges **74*a*,74*b* extend laterally outwardly from each longitudinal edge of the front side 66, perpendicular to the lateral sides 68,70. The flanges 74*a*,74*b* and front side 66 have a complementary size and shape to the T-shaped slot 46 for sliding insertion therein. The channel member 22 has an overall width between the outer edges of the flanges 74*a*,74*b* of a distance $D_3$ slightly greater than the width $D_2$ between the engaging portions 50*a*,50*b*, and marginally less than the width $D_1$ of the end 48. The size and complementary shape of the flanges 74*a*, 74*b* is such that the flanges 74*a*,74*b* and front side 66 can be slid into a slot 46 by relative longitudinal sliding of the channel member 22 into a slot 46, so that the flanges 74*a*,74*b* locate between a respective vertical edge portion of the end 48 and the overlapping shoulder portion 50*a*,50*b*. The sliding insertion of the front surface 66 and flanges 74*a*,74*b* into the slot 46 interlocks the associated pilaster and channel member in a channel-lock configuration, preventing lateral withdrawal or movement of the channel member 22 relative to the pilaster 18,20**.

The lateral sides 68,70 are spaced from each other a distance marginally less than the distance $D_2$ to permit their unhindered insertion between the shoulder portions **50*a*,50*b* on inserting the front side 66 into an associated pilaster slot 46. Each lateral side 68,70 includes respectively an elongated support web 76,78 extends parallel to the axis $A_1$ therefrom. The support webs 76,78 project perpendicularly from a medial portion of each respected side 68,70 inwardly into the channel member 22, with the ends of the webs 76,78 spaced from each other by the same distance as the width of the opening 72, permitting movement of a panel edge 57 or narrower edge portion 54,56** therebetween.

As will be described hereafter, the channel members 22 function as a modular component which may be cut to any desired length for installation coupled to the rearward surface 34 of the pilasters 18,20 to form composite vertical posts, and/or for supporting the vertical edges **57*a*,57*b* of divider panels with any cut edges thereof hidden from view, and/or for supporting pilasters 18,20** in a vertical orientation.

D. Door Assembly

The door assembly 24 is provided in each door opening 28 to permit access into the cubicles 14 and providing a user with desired privacy. The door assembly 24 is shown best in FIGS. 9 to 22 as including a rectangular door panel 98 and a continuous hinge assembly 100. Although not essential, the door panel 98 is formed from the same laminated particle board as that used for the divider panels 16, and has the same thickness $T_2$. The door panels 98 may be provided with pre-finished top, bottom and one vertical side edge 102,104, 106, and is configured to be cut on-site on a table saw, along the second other vertical side edge 108 to custom fit the panel 98 to the width of the door opening 28.

Figure 9:
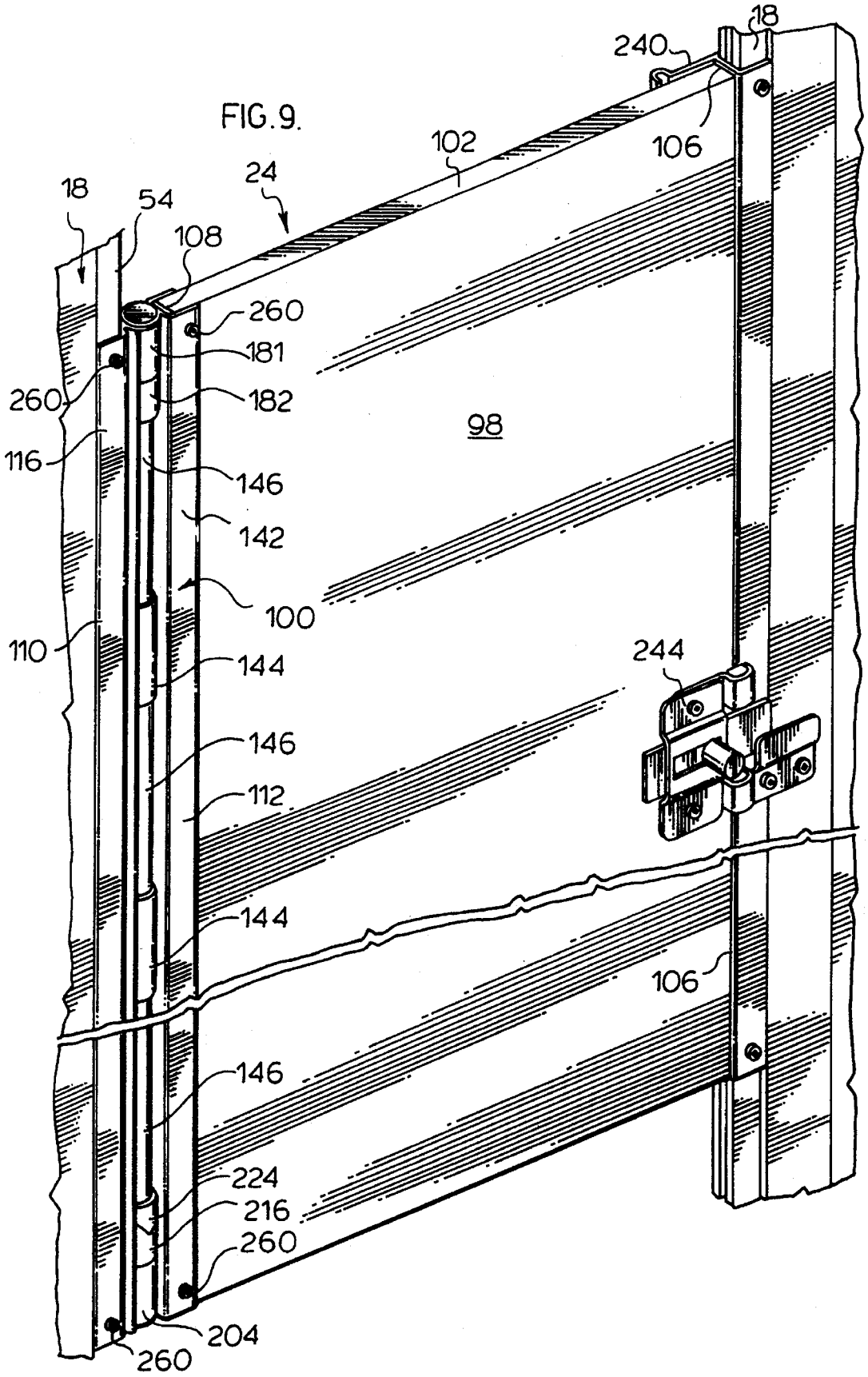
FIG. 9 shows a perspective rear view of a door panel and hinge assembly used in the construction of FIG. 1.

The continuous hinge assembly 100 pivotally mounts the door panel 98 to the narrower edge portion 54,56 of either of the pilasters which define the door opening 28 and is configured for attachment to the panel 98 so that the cut side edge 108 is hidden from view. FIGS. 1, 2 and 9 show the door panel 98 hingely coupled to edge portion 54 of each of pilaster 18,20 so that the door panel 98 opens inwardly, however the present hinge assembly 100 may equally be used to couple the panel 98 so as to open outwardly as for example, for use in cubicles which permit wheelchair access.

The hinge assembly 100 is also of a modular construction so that it may be trimmed to the same length as the vertical side edge 108 providing the structure 10 with an overall finished appearance. As shown best in FIGS. 10 to 22, the hinge assembly 100 includes two elongated hinge arm members 110,112 which are movable relative to each other.

Figures 11, 13:
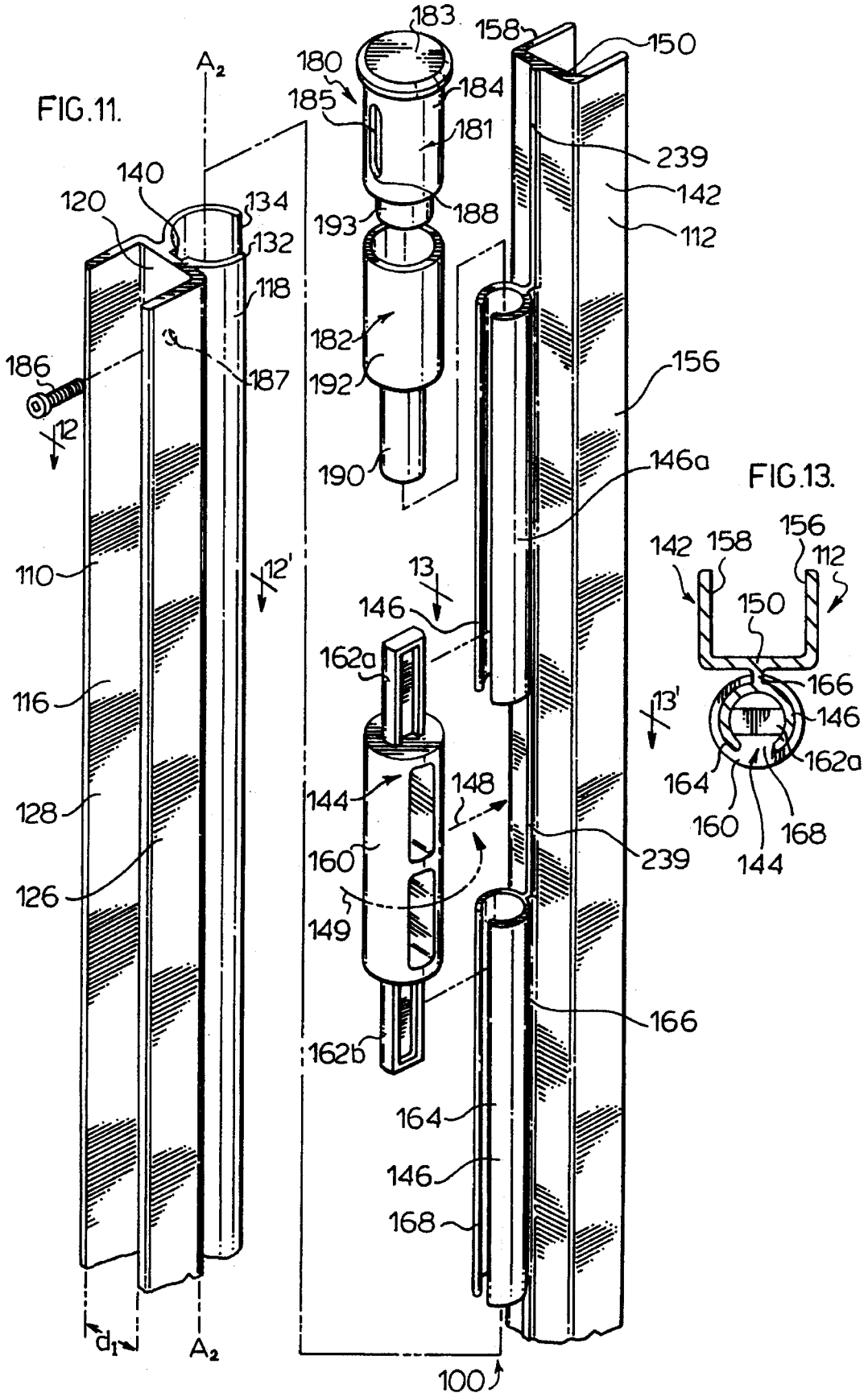
FIG. 11 is an exploded view of an uppermost portion of the hinge assembly shown in FIG. 9.
FIG. 13 is shown with FIG. 11 and is a cross-sectional view of the second hinge arm of the hinge assembly of FIG. 11 taken along lines 13–13'.

The first arm member 110 seen best in FIG. 11 is formed as an elongated aluminum extrusion having two integrally formed channels, a first square U-shaped channel 116 for coupling the arm member 110 to a pilaster edge portion 54, and a second open C-shaped channel 118 which is elongated along an axis $A_2$ and which rotatably couples therein part of the second arm member 112.

The U-shaped channel 116 includes a rectangular base member 120 which is elongated in a direction parallel to the axis $A_2$, and two parallel spaced sides 126,128 projecting forwardly from each elongate edge of the base member 120. The base member 120 has a dimension selected so that the innermost distance $d_1$ between the sides 126,128, is marginally greater than the thickness $T_2$ of the narrower edge portions 54,56 and door panel 98. Preferably, the sides 126,128 are configured so that either edge portion 54,56 may be snugly inserted therein, and when so inserted, the sides 126,128 overlap the respective edge portion 54,56 to form a flush surface with the adjacent part of the forward and rearward surfaces 32,34 in the configuration shown in FIGS. 19 and 20.

Figure 12:
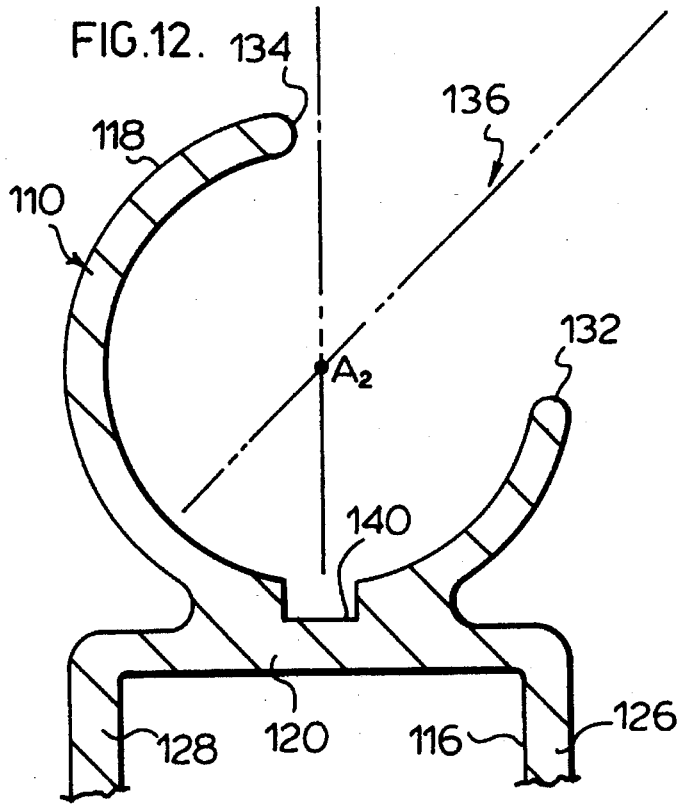
FIG. 12 shows an enlarged partial cross-sectional view of the first hinge arm of the hinge assembly of FIG. 11 taken along lines 12–12'.
Figure 18:
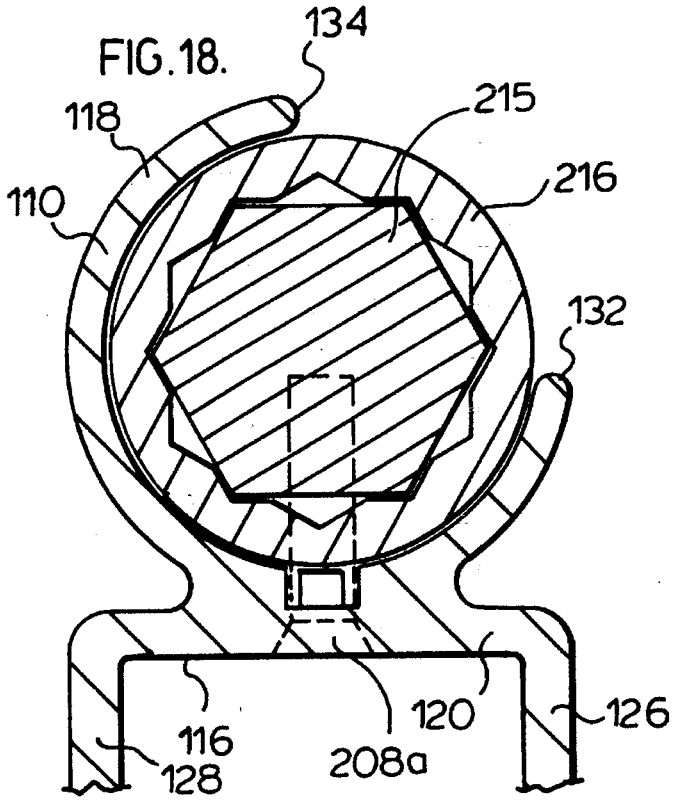
FIG. 18 is shown together with FIG. 12 and is a cross-sectional view of the biasing assembly of FIG. 16 taken along lines 18–18'.
Figure 14:
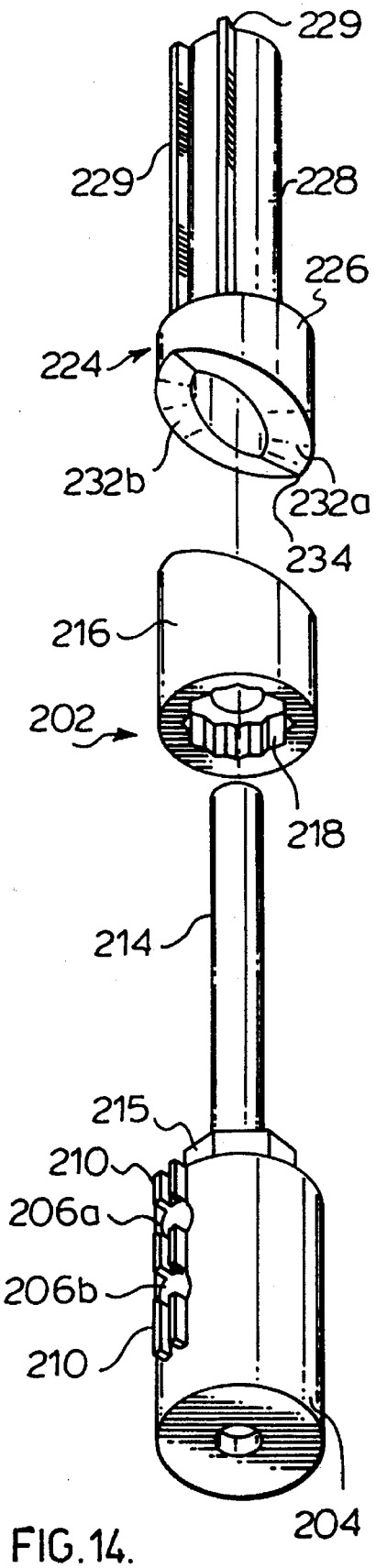
FIG. 14 shows an exploded view of a gravity operable biasing assembly for biasing the door panel of FIG. 9 to a normal rest position.

As seen best in FIG. 12, the C-shaped channel 118 projects from the longitudinal center of the base member 120 in the opposite direction to that of the sides 126,128. In cross-section through the axis $A_2$, the C-shaped channel 118 extends from a first channel edge 132 to a second channel edge 134 along an arc of a circle of approximately 260° which is centered on the axis $A_2$. The first and second channel edges 132,134 defining a channel opening 136 therebetween. The open C-shaped channel 118 extends in a first direction from the longitudinal center of the base 120 to the first channel edge 132, along a first arcuate segment about 85° and from the center of the base 120 to the second channel edge 134 along a second arcuate segment extending in an opposite direction through about 175°. A groove 140 formed in the inner surface of the channel 118 extends longitudinally therealong where the channel 118 joins with the base member 120.

The second arm member 112 is similarly elongated and, as seen best in FIG. 11, includes a second square U-shaped channel 142 for coupling the arm member 112 to the door panel edge 108, a number of modular plastic bearing members 144 having a radius slightly less than that of the C-shaped channel 118 for rotatable insertion therein, and a number of clips 146 formed at equally spaced locations along the channel 142 for mechanically coupling the bearing members 144 thereto.

The U-shaped channel 142 and clips 146 are integrally formed as an aluminum extrusion with the channel 42 having the identical construction and dimensions as U-shaped channel 116. The U-shaped channel 142 includes an elongated base member 150, and parallel spaced sides 156,158 projecting forwardly from each elongate edge of the base member 150. Like the sides 126,128, the sides 156,158 are separated by an innermost distance $d_1$ which is marginally greater than the thickness $T_2$ of the door panel 98 and edge portions 54,56. The spacing of the sides 156,158 permitting insertion of the cut edge 108 therein so that the cut portion of the door panel 98 is concealed from view.

The bearing members 144 are provided as a modular component which in assembly of the hinge assembly 100 are manually coupled to the clips 146, and inserted into the channel 118 aligned with the axis $A_2$ for rotational movement therein. Each bearing member 144 has an overall axial length of about 24 cm and includes a centrally disposed cylindrical bearing portion 160 approximately 12 cm in length, and two generally rectangular finger-like projections **162*a*,162*b* extending from the axial center of the respective upper and lower ends of the cylindrical bearing portion 160**.

The cylindrical bearing portion 160 has a diameter which is slightly less than the diameter of the C-shaped channel 118, and which is selected to permit the sliding axial insertion of the bearing members 144 into the channel 118 in alignment with the channel axis $A_2$. The diameter of the bearing portion 160 is small enough to permit its rotational movement in the channel 118 and large enough to prevent the withdrawal of the bearing member 144 radially outwardly from the channel 118 through the channel opening 136. The bearing member 144 advantageously engages the inside of the C-shaped channel 118 as a pivot guide and blocks the channel opening 136 to prevent the fingers of smaller children accidentally being caught between the arm members 110,112 as the door panel 98 pivots open and closed.

The clips 146 are each elongated in the longitudinal direction and include an open cylindrical gripping portion 164 having an open longitudinally extending slot 168 therein and a planar supporting web 166 extending along the center of the base member 150. The clips 146 have a length selected to receive therein a finger-like projection **162*a*,162*b* of each adjacent bearing members 144, with each clip 146 longitudinally spaced from its two adjacent clips 146 by a distance of marginally greater than 12 cm, permitting insertion of the cylindrical bearing portion 160 of a bearing member 144** therebetween.

As shown in FIG. 13, in cross-section the gripping portion 164 extends as a second C-shaped channel having a radial diameter smaller than that of C-shaped channel 118, and which defines an arc of a circle of about 300° open to the slot 168. FIG. 11 shows best the coupling of the bearing members 144 to the clips 146 wherein a narrow side of each finger-like projection **162*a*,162*b* is inserted into the corresponding slots 168 of the adjacent clips 146 in the direction of arrow 148 and the bearing portion 160 is moved into position between the clips 160 so that a peripheral edge portion is adjacent the base member 150. The bearing member 144 is then rotated 90° in the direction of arrow 149 to couple it to the remainder of the arm member 112. As seen best in FIG. 13, the rotation of the bearing members 144 brings the wider side of the projections 162*a*,162*b* into alignment with the slot 168 preventing their removal therethrough to mechanically couple each bearing member 144 thereto. It is to be appreciated that the projections 162*a*,162*b* are constructed so as to have a narrow side which is slightly smaller and a wider side which is slightly larger than the width of the slot 168**.

Each supporting web 166 projects perpendicularly from the base member 150 to a portion of its associated cylindrical gripping portion 164 radially opposite the slot 168. The web 166 is provided with the smallest thickness possible required to maintain structural integrity of the hinge assembly 100, and preferably a thickness of less than 1 mm. The supporting web 166 projects from the base member 150 a distance selected so that when the bearing members 144 are coupled to the gripping portions 164 and inserted within the C-shaped channel 118, the cylindrical bearing portions 160 co-axially locate with the axis $A_2$ with the webs 166 extending radially outwardly through the channel opening 136, and when the webs 166 are pivoted to the second channel edge 134, the spacing between the U-shaped channel 142 and the second channel edge 134 is minimized with the base member 150 immediately adjacent the edge 134.

Figure 10:
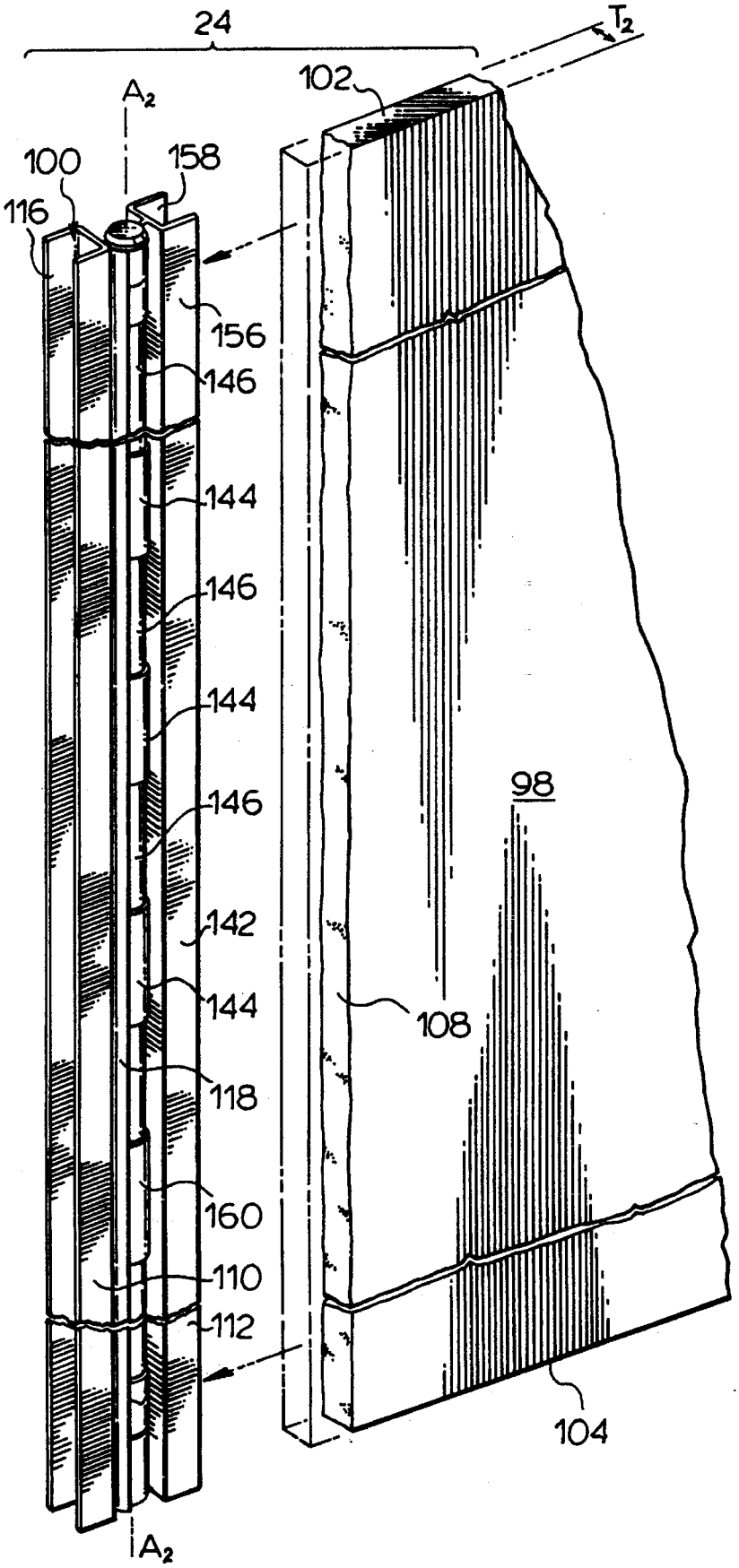
FIG. 10 is an exploded view of the door panel and hinge assembly shown in FIG. 9.

While FIG. 10 shows four equally spaced bearing members 144, it is to be appreciated that clips 146 of varying lengths and more or fewer bearing members 144 may be used with the hinge assembly 100 preferably including at least one bearing member 144 spaced towards both the top and bottom of the hinge assembly.

Figure 20:
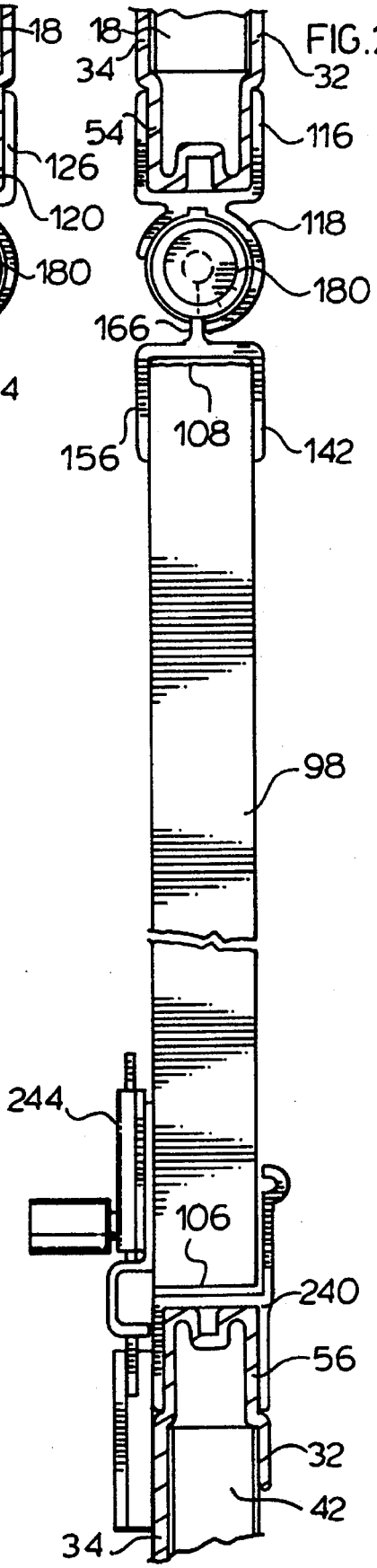
FIG. 20 shows a cross-sectional view of the door of FIG. 18 in a fully closed position.
Figure 21:
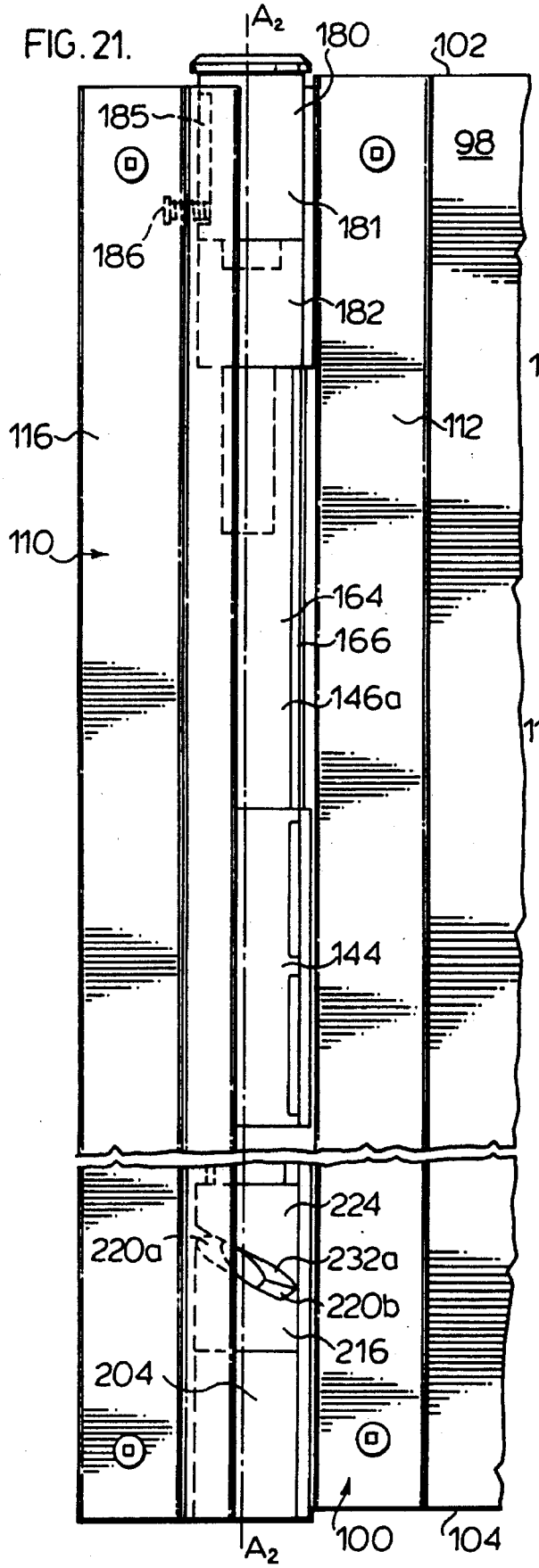
FIG. 21 shows a partial rear schematic view of the hinge assembly of FIG. 9 with the door fully closed.
Figure 22:
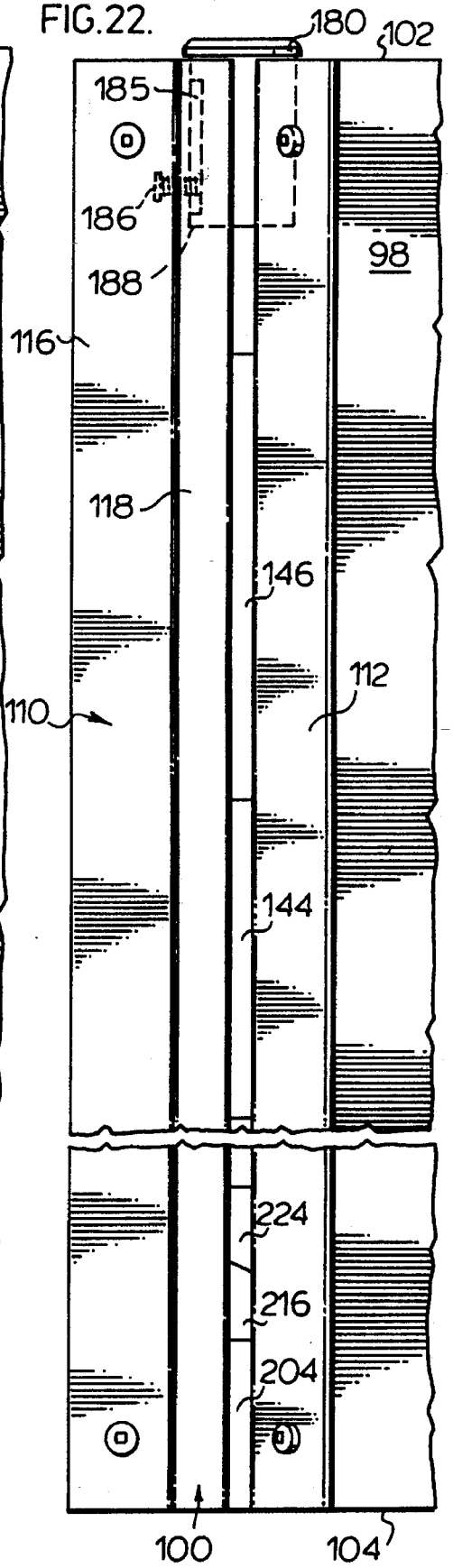
FIG. 22 shows the rear schematic view of the hinge assembly of FIG. 21 with the door in a partially open rest position.

FIGS. 11, 20 and 21 illustrate a capping plug 180 installed in the uppermost end of the hinge assembly 100 to limit upward vertical sliding of the arm member 112 relative to the arm member 110.

The capping plug 180 consists of a cylindrical insert 181 and a spacer member 182. The insert 181 includes a cylindrical end 184 which acts as a bearing member and has having a diameter slightly less than the inside diameter of the C-shaped channel 118 for insertion therein, and a larger diameter upper cap 183 co-axial with the end 184. A vertically extending recess 185 is provided along a peripheral side of the end 184. The recess 185 is sized to receive therein the end of a limiting screw 186, shown in FIG. 11, driven through a bore 187 formed through the base member 120 and guide groove 140.

The spacer member 182 includes a narrow diameter cylindrical lower portion 190 which is sized for insertion axially into the upper end of the gripping portion 164 of an uppermost clip **146*a*, and a cylindrical upper bearing portion 192 which engages the lowermost end of the insert 181**.

With the spacer member 182 positioned in the gripping portion 164, the insert 181 is slid into in the upper end of the C-shaped channel 118 so that the cylindrical end 184 is axially disposed therein and the cap 183 extends thereabove. The screw 186 is then inserted via the bore 187 into an upper part of the recess 185. The screw 186 projects into the recess 185 spaced above the lowermost end 188 so that the plug 180 may be slid upwardly relative to the screw 186. As seen best in FIGS. 20 and 21, the engagement of the limiting screw 186 with the lowermost end 188 of the recess 185 and the engagement of the cap 180 with the uppermost clip **146*a* acts to limit further upward movement of the arm member 112 relative to the arm member 110. If desired, the recess 185 may have a length selected to permit the door panel 98 to be lifted above a latching mechanism, as for example is indicated by numeral 244 in FIG. 9, and allow emergency access into the cubicle 14**.

FIGS. 14 to 18 show a lower stop plug 202 which is secured in position axially aligned in the channel 118 for limiting downward vertical sliding of the arm member 112 relative to the arm member 110. By gravity, the stop plug 202 also functions to preset the angle at which the door panel 98 will come to rest when the cubicle 14 is unoccupied.

The stop plug 202 includes bottom cylindrical element 204 which acts as a bearing member and is substantially the same diameter as the cylindrical bearing portion 160, a guide pin 214 having an enlarged hexagonal shaped lower end 215, and lower and upper camming members 216,224. The camming members 216,224 each have a central bore therethrough for insertion over the pin 214, and are configured to engage each other to urge the door panel 98 to its rest position.

The cylindrical element 204 is coupled in a lowermost end portion of the C-shaped channel 118 to prevent movement of the second arm member 112 downwardly therepast. Two axially spaced threaded bore holes 206*a*,206*b* are provided along a peripheral edge of the element 204. The holes 206*a*,206*b* are sized to receive therein respectively anchor screws 208*a*,208*b* driven through longitudinally spaced bores 209*a*,209*b* formed through the base member 120 and guide groove 140. Guide webs 210 project longitudinally along the peripheral edge of the element 204 aligned with the bore holes 206*a*,206*b*. The webs 210 are sized to engage the guide groove 140 and orient the bore holes 206*a*,206*b* in line with bore holes 209*a*,209*b*. A hexagonally shaped recess 212 provided in the upper end of the element 204, is sized to receive therein in a complementary fit the hexagonal end 215 of the guide pin 214. The recess 212 has a depth selected so that an uppermost portion of the hexagonal end 215 projects above the cylindrical element 204 in the manner shown in FIG. 14.

The lower camming member 216 has formed therein a 24 sided, polygonally shaped bottom recess 218. The recess 218 is sized for placement over the guide pin 214, so that the upper portion of the hexagonal end 215 is engagingly received therein. The engagement of the end 215 in the recess 218 permits the positioning of the member 216 over the end 215 in a number of different radial positions, while preventing its rotational movement relative to the C-shaped channel 118. As seen best in FIG. 17, the upper surface of the lower camming member 218 is provided as two intersecting camming surfaces 220*a*,220*b*. The surfaces 220*a*, 220*b* curve symmetrically upwardly about the central bore, in opposite directions in a slow helix which rotates relative to the horizontal plane as they incline.

The upper camming member 224 is coupled to the hinge arm 112 immediately above and in contact with the lower camming member 216. The upper camming member 224 includes a lower cylindrical tip portion 226 having a diameter marginally less than that of the C-shaped channel 118 and an upwardly extending reduced diameter portion 28. The reduced diameter portion 228 is cylindrical in shape having a radius selected to permit its insertion into the lower end of the gripping portion 164 of a lowermost clip 146*b*. As seen best in FIGS. 15 to 17, two radially extending webs 229 project from the reduced diameter portion 28. The webs 229 are spaced so as to engage the open edges of the slot 168 and prevent rotational movement of the camming member 224 relative to the arm member 112.

The lower surface of the tip portion 226 includes two symmetrical intersecting surfaces 232*a*,232*b* which curve upwardly about the central bore in opposite directions, each in a slow symmetrical helix which rotates relative to the horizontal plane. The helical surfaces 232*a*,232*b* are complementary to the helical surfaces 220*a*,220*b* for mated engagement therewith.

Figure 19:
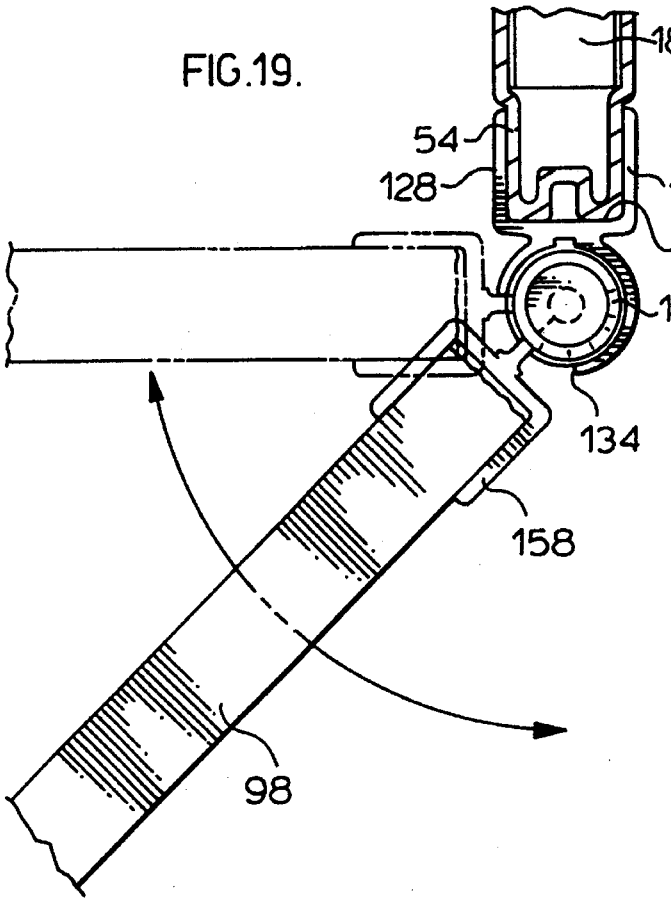
FIG. 19 shows a partial cross-sectional view of the door of FIG. 9 at the rest and fully opened position.

The helical surfaces 232*a*,232*b* and helical surfaces 220*a*, 220*b* each define respective lower points of intersection 234,236. At the rest position the lower point of intersection 234 and the upper helical surfaces 232*a*,232*b* are moved into juxtaposition with the lower point of intersection 236 and the lower helical surfaces 220*a*,220*b* as shown in FIG. 16. As shown in FIG. 19, as the door panel 98 pivots from the rest position, as for example, on the door panel 98 being moved to the fully open position shown in phantom, or to a fully closed position, the upper camming member 224 pivots with the arm member 112, rotating about the axis $A_2$ relative to the lower camming member 216. The relative rotation of the upper camming member 224 moves the helical surfaces 220*a*,220*b*,232*a*,232*b* out of juxtaposition to the position shown in FIG. 17. As the arm member 112 pivots relative to arm member 110 with the door panel opening, the lower helical surface 232*a* slides upwardly along the upper helical surface 220*a*. The upward movement along the helical surface 220*a* forces hinge arm member 112 and the door panel 98 upwardly relative to the arm member 110 to the position shown in FIG. 17. As seen best in FIG. 20, movement of the door panel 98 and channel member 112 to the fully closed position similarly slides the surface 232*b* upwardly along surface 220*b* to raise the door panel 98 in the similar manner. As the door panel 98 raises the cap insert 181 is slid upwardly relative to the screw 186 to the position shown in FIG. 21 by the bias of the spacer member 182.

Once the door panel 98 is released, downward gravitational forces on the door panel 98 cause the lower helical surface 232*a* to slide downwardly along the upper helical surface 220*a* (or surface 232*b* to slide downwardly along surface 220*b*). The weight of the door panel 98 urges the respective lower camming surface 232*a*,232*b* into rotational sliding movement downwardly along the corresponding upper camming surface 220*a*,220*b* until the lower points of intersection 234,236 are returned to juxtaposition, and the door panel 98 to the rest position.

It is to be appreciated that by the use of the stop plug 202 of the present invention, the hinge assembly 100 maybe used to pre-set the door panels 98 of unoccupied cubicles move to a slightly open position, or if desired to a fully closed or fully opened position. As seen best with reference to FIGS. 16 and 17, by the radial positioning the lower point 236 of the lower camming member 216 relative to the axis $A_2$, the angle at which the cubicle door panel 98 will rest may easily be pre-set.

It is to be further appreciated that by the use of channel member 112 having a number of separate equally spaced clips 146 and modular bearing members 144, the hinge assembly 100 may be easily cut to almost any desired length and assembled simply by inserting the required number of bearing members 144, together with the upper capping plug 180 and lower stop plug 202. As the cut vertical side edges 108 of the door panels 98 are concealed within the channels 142 of the respective hinge assemblies, the doors may be cut on site to any desired width, permitting the partition structure 10 to be erected with any number of same size cubicles 14 and/or doors, without having to pre-measure components.

The hinge assembly 100 provides the washroom cubicle 14 with excellent privacy as the gap between the cut edge 108 of the door panel 98 and the adjacent edge portion of the pilaster 18,20 are substantially eliminated. As seen best in FIGS. 20 and 21, when the door panel 98 is moved to the fully closed position, the second channel edge 134 is moved immediately adjacent the base member 150 effectively eliminating any visible gaps therebetween. More preferably the clips 142 are provided with a radial diameter slightly less than the radial diameter of the channel 118, so as to prevent the fingers of small children from accidentally being caught between the arm members 110,112.

Although not essential, a longitudinally extending rib 239 or raised portion shown in FIG. 11 may be provided along the center of the base member 150 extending between adjacent webs 166. The rib 239 together with the webs 166 are abutted by the second channel edge 134 in the manner shown in FIG. 20 when the door panel 98 moved to in the fully closed position.

More preferably, by including as part of the door assembly 24, an h-shaped door stop 240 shown in FIG. 9 and 20 for limiting outward movement of the opposite vertical edge 106 of the door panel 98, gaps between the open side edge 106 of the door panel 98 and the adjacent pilaster can be eliminated. The door stop 240 preferably is provided with a channel portion 242 which is identical in size and construction to the second U-shaped channel 142 for placement over the edge portion 54,56 of the opposing pilaster 18,20. By the use of U-shaped channels 116,142 each having the same innermost spacing $d_1$, the hinge assembly 100 may be equally assembled so that the door panel 98 opens either inwardly or outwardly from either pilaster which form the left or right sides of the cubicle door opening 28.

Floor-Mounted/Overhead Braced Assembly

FIGS. 1 to 3 show the partition structure 10 assembled in a floor-mounted and overhead braced configuration.

In the floor-mounted construction, the pilasters 18,20 are assembled by cutting the aluminum shells 40 to length and the inserts 42 to the desired length and width, and then sliding the inserts 42 into position behind the front opening 72 of the associated pilaster 18,20. Two corner pilasters 20 are provided for positioning at each end of the partition structure 10 with the rounded corners 62 positioned outwardly. The pilasters 18,20 are coupled to a corresponding channel member **22*a* to form vertical posts by sliding the front side 66 of channel member 22 into the T-shaped slot 46 of each corresponding pilaster 18,20 so that the flanges 74*a*,74*b* engage the shoulder portions 50*a*,50*b*** in an interlocking configuration.

FIGS. 2 and 4 show best the installation of the divider panels 16 in the partition structure 10. A second channel member **22*b* is paired with each channel member 22*a*, and coupled to the wall 12 by driving screws 250 through the front side 66 into the wall 12. The second channel members 22*b* are secured in position in a vertical orientation with their front sides 66 abutting the wall 12 and the opening 72 aligned with and coplanar to the opening 72 of the corresponding paired channel member 22*a*. The channel members 22*a* and 22*b* are cut to a vertical height so that when coupled to a pilaster 18,22, or wall 22, the channel member 22 extend vertically above the floor 13 a distance to the top of the divider panels 16. It is to be appreciated, that to achieve a different look, the channel members 22*a*** need not extend all the way to the floor, and for example if desired, could be coupled to the pilasters above the floor extending only from the bottom to the upper edges of the divider panels.

The divider panels 16 are cut along at least one vertical edge **57*a*,57*b* to the length required to substantially span the distance between the wall 12 and the pilaster rearward surface 34. The vertical edges 57*a*,57*b* of each divider panel 16 is inserted into the respective opening 72 of each pair of channel members 22*a*,22*b*, where they are completely concealed from view. Once so positioned, the divider panel 16 is secured in place in the channel members 22 by mechanical fasteners such as screws (not shown) driven through the channel member sides 68,70. Alternately, as an elongated spacer block inserted into the channel member 22 or other such means may be used to position the divider panel 16 and will now become apparent. FIG. 4 shows best end caps 254 coupled over the open upper and lower ends of the channel members 22** by screws to provide a finished appearance.

The vertical posts are anchored to the floor 13 in position defining the door openings in the manner shown in FIGS. 4, 5, 6 and 8. A lowermost end of each channel member **22*a* is attached to a corresponding floor-mounted shoe 255 by screws 257 or the like. The shoe 255 has an upwardly projecting portion configured to engage the inside of the end of the channel member 22*a* to limit movement of the respective vertical post thereon. FIG. 4 shows best a shoe 255 adapted for insertion into a channel member 22 which is sized to receive one edge of a ¾" thick vertical panel 16. It is to be appreciated that where the channel members 22 are to be used to secure ½" panels 16, a shoe 255** having a narrower profile is to be used.

The uppermost ends of the pilasters 18,20 are braced together by attaching the cross-brace 26 thereto by screws 259. As seen best in FIG. 6 end trim members 37 are attached to the outside top of the corner of each pilaster 20 to provide the partition structure with a surface flush to the overhead brace 26.

Although not shown, extruded nylon sealing strips may be provided to cover any exposed channel openings 72. The sealing strip may be configured for attachment to the channel members 22 by hand in a snap-fit manner, to substantially cover openings 72 and prevent dirt and the like from accumulating therein.

To install the door assemblies 24, each respective door panel 98 is cut along the vertical edge 108 to the width required to span the door opening 28. The hinge assembly 100 is next trimmed to the length of the vertical door edge 108 and the required number of bearing members 144 are coupled in place between each pair of adjacent clips 146.

The bottom cylindrical member 204 of the camming plug 202 is next inserted into the C-shaped channel 118 with the bore holes **206*a*,206*b* aligned with the bore holes 209*a*,209*b* and the guide web 210 received in the guide groove 140. Screws 208*a*,208*b* are driven through the respective holes 209*a*,209*b* to engage the bore holes 206*a*,206*b* and secure the cylindrical plug 204 coupled to the C-shaped channel 148. The guide pin 214 is then inserted into the hexagonal recess 212, and the lower camming member 216 positioned on the end 215 so that the helical surfaces 220*a*,220*b* will orient the arm member 112 and door panel 98 at a desired rest position. With the upper camming member 224 secured in an end of a gripping portion 164 of the lowermost clip 146*b*, the upper camming member 224 and bearing members 144 are axially slid into the C-shaped channel 118 so that the lower helical surfaces 232*a*,232*b* are moved against the upper helical surfaces 220*a*,220*b*. The cap plug 108 is then inserted and secured in place by driving the screw 186 through the base member 120 into the longitudinal recess 185, to prevent the withdrawal of the bearing members 144 from the open channel 118**.

As shown best in FIG. 9, the hinge is then positioned with the first arm member channel 116 slid over the edge portion 54 and the second arm channel 142 placed over and concealing the cut edge 108 of door panel 98. The hinge assembly 100 is then secured in place to the respective edge 54 and panel 98 by screws 260 or the like.

The door assembly is completed by attaching the h-shaped door stop 240, with the channel portion 242 placed over the edge portion 56 of the second other pilaster defining the door opening 28. It is to be appreciated that the identical construction of the edge portions 54,56 and that of the channels 116,142 and channel portion 242 permit the door panel 98 and/or either arm member 110,112 to be coupled to either of the pilaster which defines the door opening 28 and in such a manner so that the door panel 98 opens either outwardly or inwardly from either side.

With the door panel 98 installed, a conventional sliding lock mechanism 244 shown in FIG. 9 may then be installed over the vertical edge 106 to complete the cubicle 14.

Floor Mounted Configuration

Figure 23:
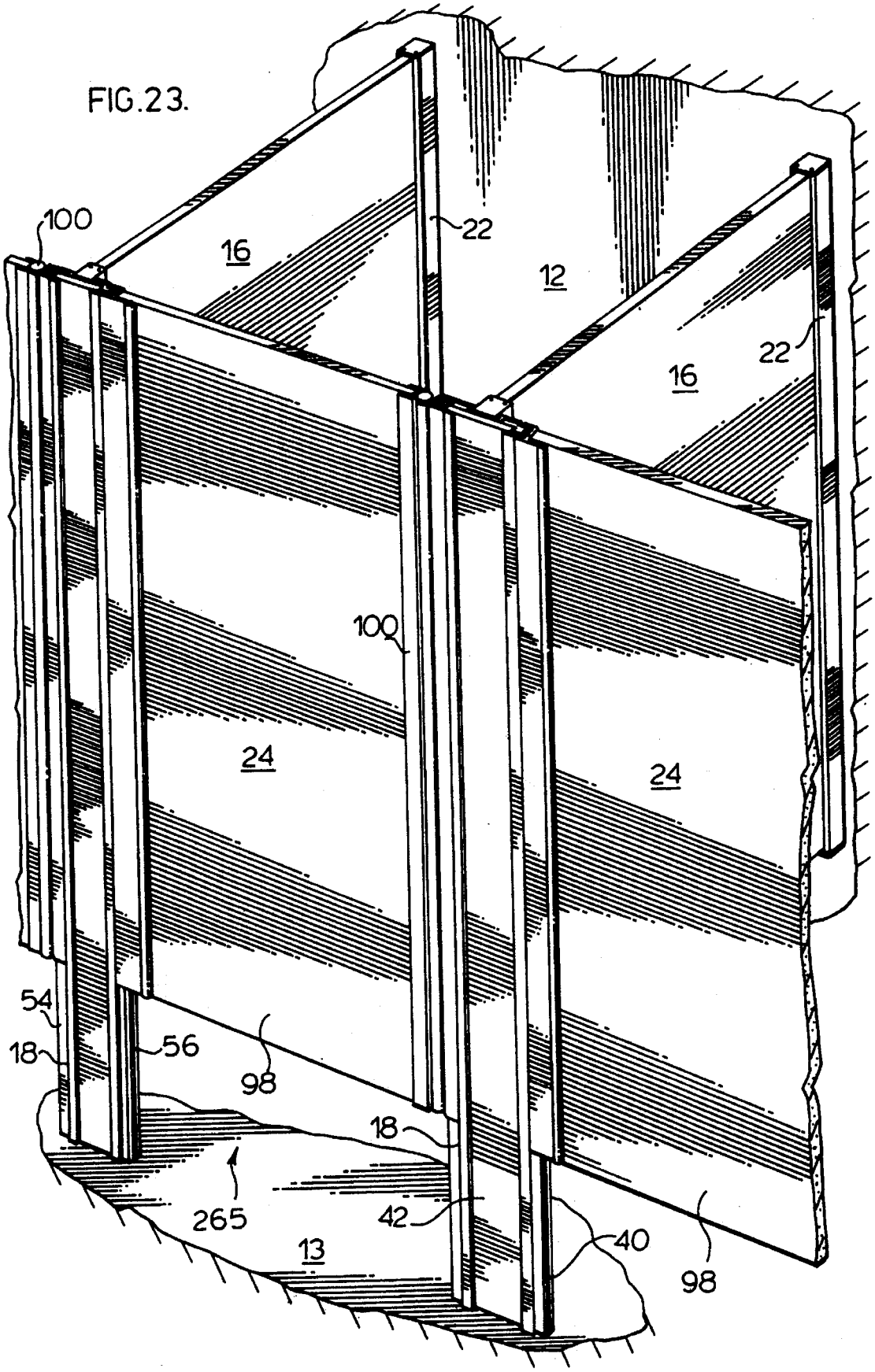
FIG. 23 shows a partial perspective view of the partition construction assembled in accordance with a second embodiment of the invention.

FIG. 23 shows a second embodiment of the invention in which the divider panels 16, pilasters 18,20, channel members 22 and door assembly 24 are used to assemble a partition structure 265 in a floor mounted configuration.

The erection of the vertical posts and the attachment of the divider panels 16 to the pilasters 18,20 and wall 12 is achieved in an identical manner to the partition structure 10 shown in FIG. 1, with the exception that the overhead cross-brace 26 is not provided, but rather the height of the pilasters 18,20 are maintained at the same height as that of the top of the divider panels 16.

Ceiling Hung Configuration

Figure 24:
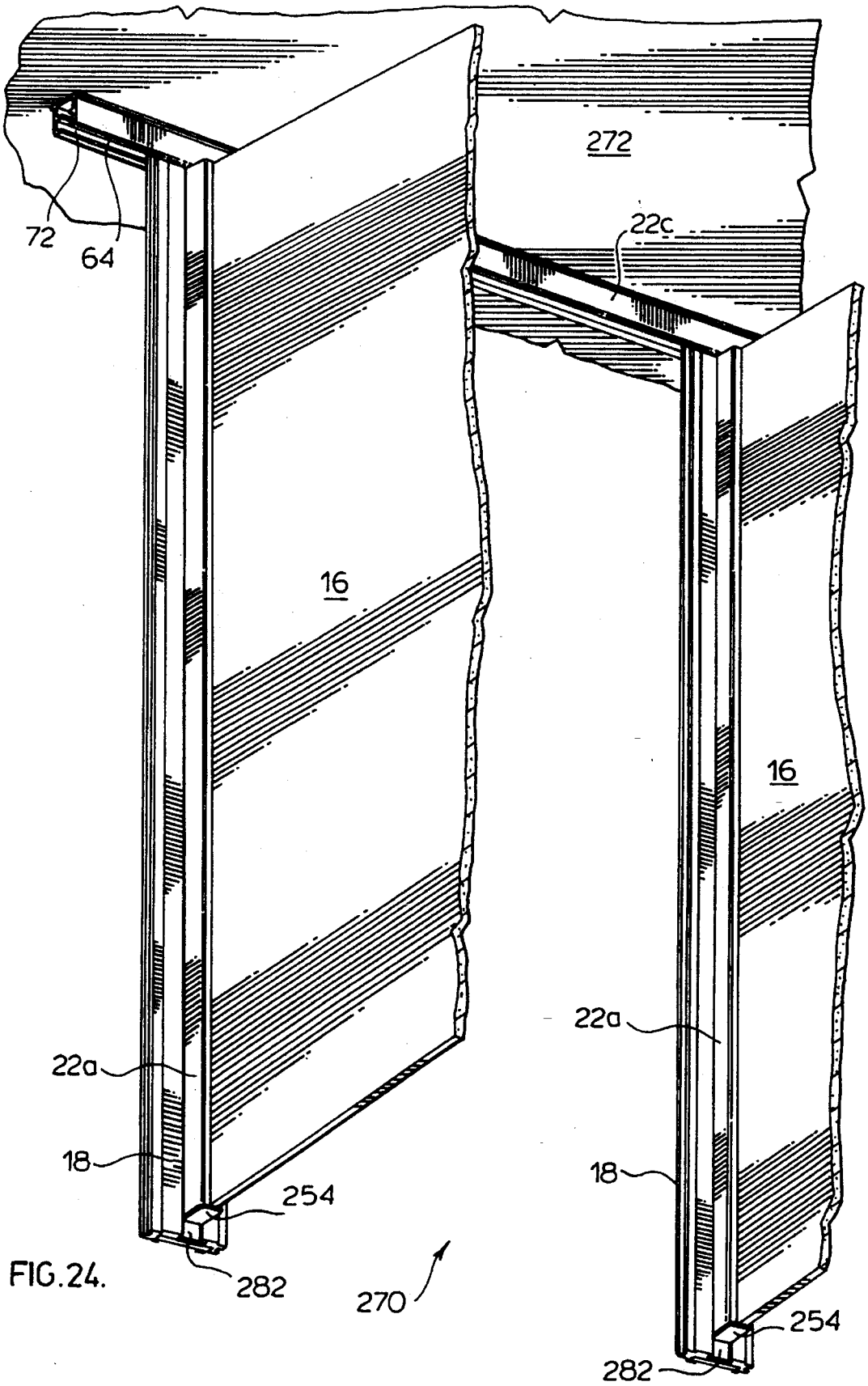
FIG. 24 shows a cut-away upward-looking rear perspective view of the partition construction assembled in accordance with a third embodiment of the invention.

FIG. 24 illustrates a third embodiment of a partition structure 270 in accordance with a third embodiment of the invention wherein like reference numerals are used to identify like components.

Figure 25:
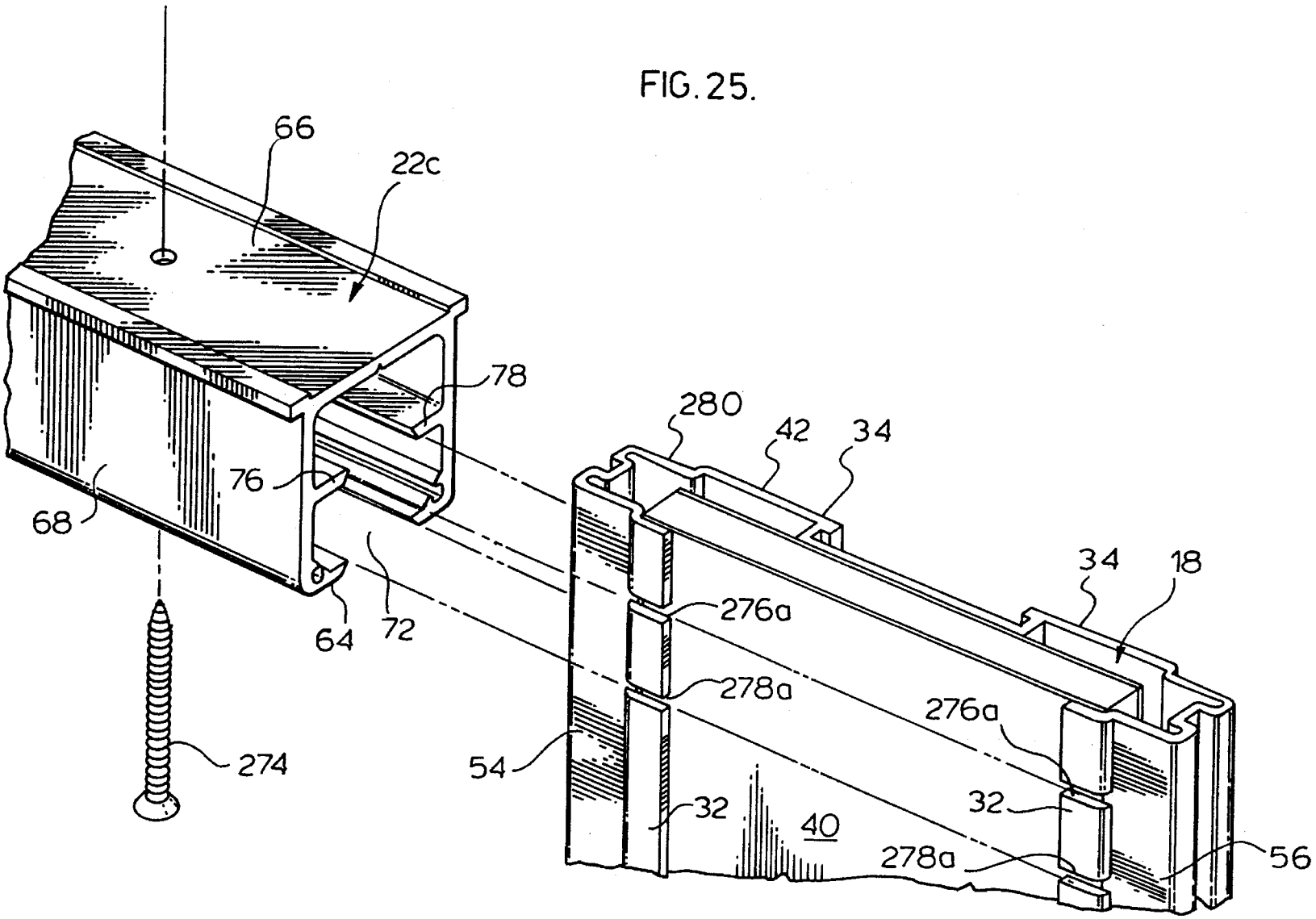
FIG. 25 shows an exploded view of a ceiling mounted channel member and pilaster for use with the construction shown in FIG. 24.
Figure 26:
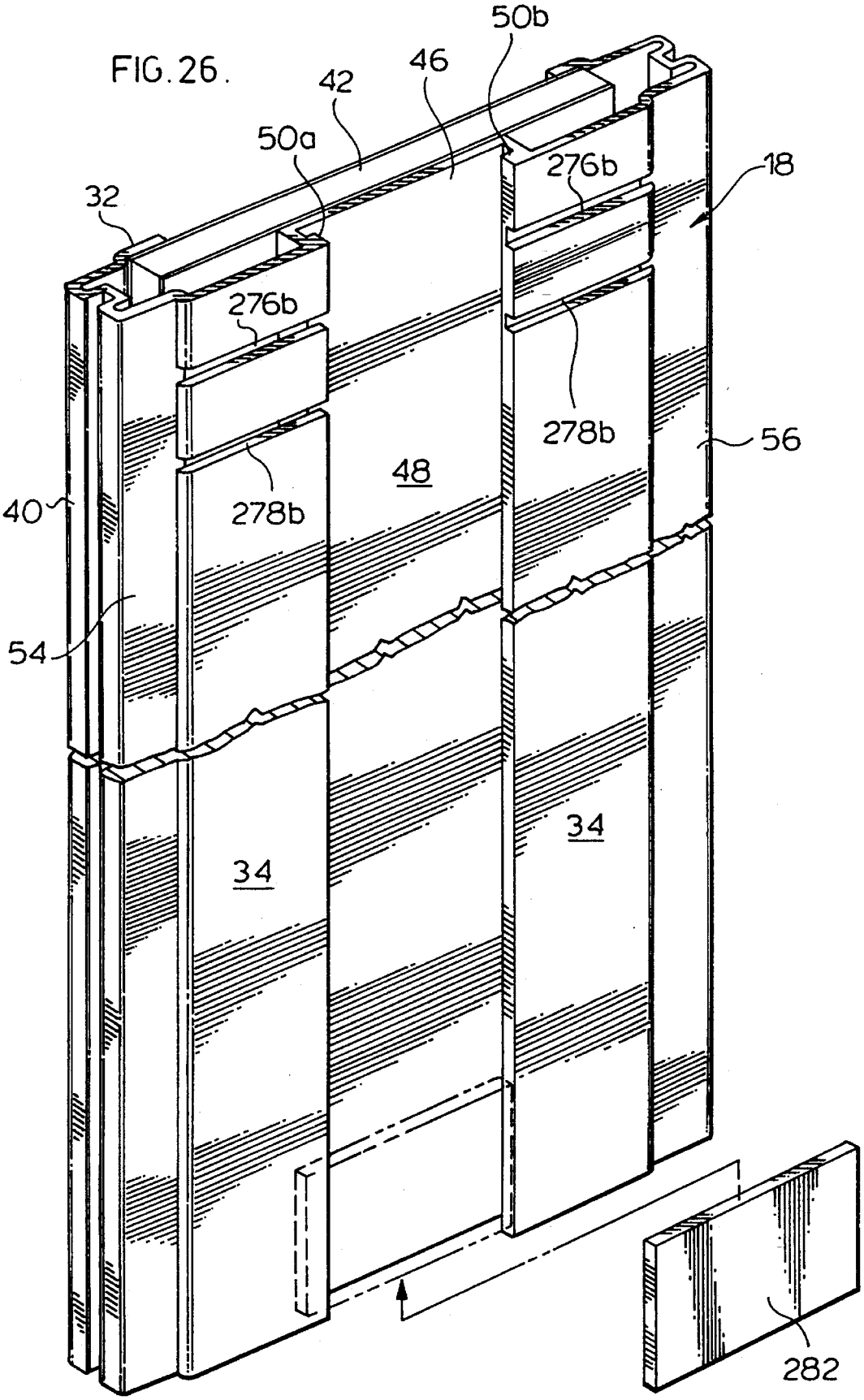
FIG. 26 shows a partial perspective rear view of the pilaster shown in FIG. 24.

In the partition structure 270 of FIG. 24, the pilasters 18,20 are suspended above the floor from a single channel member **22*c* which is attached to the ceiling 272 by screws 274 driven through the front side 66 so that the channel member opening 72 opens downwardly. As shown best in FIGS. 25 and 26, the pilasters 18 are suspended by the engagement of the front side 66 and supporting webs 76,78 of channel member 22*c* with two pairs of parallel upper and lower grooves 276*a*,276*b*, 278*a*,278*b* which are cut horizontally across the forward and rearward pilaster surfaces 32,34**.

The grooves **276*a*,276*b*, 278*a*,278*b* are formed in the pilasters 18,20 on a table saw or the like and have a depth which extends into the pilaster surfaces 32,34 so as to be even with the narrower edge portions 54,56. The grooves 276*a*,276*b*, 278*a*,278*b* are further spaced from the upper end 280 of the pilasters 18,20 and each other distances selected so that the end 280 of each pilaster may be suspended by the channel member 22*c*, with the support webs 76,78 received in and engaging respectively the upper grooves 276*a*,276*b* and the opening defining portions of the rear surface 64 received in and engaging the lower pair of grooves 278*a*, 278*b*. In this configuration, the upper ends 280 of the pilasters 18,20 may be slid into the opening 72 channel member 22*c* and held in place above the floor 13**.

The channel members **22*a* are slidably inserted into the T-shape slot 46 of the suspended pilaster 18,20 in the same manner as described with reference to FIG. 1. A flat rectangular spacer member 282 sized for fitted engagement within the slot 46 is inserted into the lowermost end of the slot 46 and held in place against removal by a screw (not shown). The spacer member 282 thereby provides a lower abutment surface upon which each channel member 22*a* coupled to the pilaster 18,20 may rest, preventing its removal from the slot 46**.

The divider panels 16, channel members **22*b* and the door assemblies 24 are installed in essentially the same manner described with reference to FIGS. 1 to 23 to complete the partition structure 270**.

While vinyl laminated particle board has been described as the preferred material for use in the pilaster inserts, divider panels and door panels, the invention is not so limited. Other materials including one or more combinations of solid plastics plastic laminates, stone, metals, woods or the like may equally be used for one or more of the disclosed components and will now become readily apparent.

While an open C-shaped channel 118 defining an arc of a circle of 260° is disclosed as a preferred embodiment, the invention is not so limited. The C-shaped channel 118 preferably defines an arc of a circle of about 260° plus or minus 20° so as to permit movement of the door panel 98 through approximately 90°. A hinge arm which has a channel member defining an arc of a circle extending between 200° and 340° could, however, also be used where more or less restricted pivotal movement of a door is desired. It is apparent that where the C-shaped channel 118 defines a smaller arc of a circle, a corresponding adjustment in the permitted tolerances of the diameter of the cylindrical bearing members is to be used.

Although the preferred embodiment of the invention discloses a hinge assembly 100 which extends the entire vertical length of the door panel 98, it is to be appreciated that although less preferred, a hinge of which part or all of which is shorter than a door may also be provided and will now become readily apparent.

While the hinge has been disclosed for use in a partition system, other applications for the hinge assembly are also envisioned and will now become apparent. In one example application shown in FIG. 2, a hinge assembly **100*a* is used to couple a divider panel in position between an angled or curved portion of the wall 12 and a pilaster 18. The hinge assembly 100*a* advantageously may be used to link two planar divider panel segments 16*a*,16*b*, each of which extends perpendicularly from a respective pilaster 18 and wall 12**.

The partition structure is disclosed in the preferred embodiment as being used to form a washroom cubicle, however it is equally adapted for use in forming simple partition walls or privacy stalls in showers, change rooms, office environments or other work areas where a durable partition structure is required.

While the construction of the pilasters, channel members and various hinge components from aluminum enables on-site cutting of these components by a portable table saw, chop saw or the like, less preferred, different materials for use in the modular system disclosed such as plastic or other metals are also possible.

Although the disclosure describes and illustrates preferred embodiments, the invention is not so limited. Many modifications and variations will now become apparent to persons skilled in this art. For a definition of the invention, reference may be had to the appended claims.

We claim:

1. A modular washroom partition construction comprising vertical post means and planar divider panel means, the post means comprising a vertical pilaster means and an elongate support channel member, the channel member having a front and a rear with an elongate opening in its rear extending the length of channel member, the pilaster means having on its rearward surface vertically extending slot means, means to locate the channel member longitudinally relative the slot means, wherein the pilaster means and channel member are coupled together with the front of the channel member received in the slot means for longitudinal relative sliding, and the planar divider panel means having a forward vertical edge portion, and being coupled to the channel member extending rearwardly from the post means with the vertical edge portion secured within the opening of the channel member.

2. A partition construction as claimed in claim 1 wherein the front of the channel member and the slot means are configured so that when the front of the channel member is received in the slot means, the channel member and pilaster means are fixed to each other for relative longitudinal sliding.

3. A modular partition construction comprising;

first and second vertical post means, said first post means spaced from said second post means and defining a door opening for a first cubicle therebetween, door means pivotally disposed in said door opening, the door means including a door panel and hinge means for hingely coupling said door panel to one of said first and second post means, planar divider panel means having a forward vertical edge portion and a rearward vertical edge portion for defining a first side of said first cubicle, and a plurality of elongate support channel members each being elongated along a longitudinal axis and in cross-section through said axis having a generally rectangular C-shape with parallel spaced front and rear sides, said rear side defining an opening therethrough extending the length on said channel member parallel to said axis, said opening having a dimension sized to receive therein one edge portion of said divider panel means, said first post means comprising first pilaster means and a first one of said channel members, said first pilaster means having a forward and rearward facing vertical surfaces, and slot means for engaging said first channel member extending vertically along said rearward surface, the slot means and front side of the channel member configured to permit the front side of the channel member to be slid into the slot means so that the first channel member and first pilaster means are fixed to each other for relative longitudinal sliding, wherein in assembly, said first channel member is coupled to said first pilaster member with said front side disposed in said slot means, the first vertical edge portion of said divider panel means is secured in said first channel member opening, and the second vertical edge portion of the panel means is secured in the opening of a second one of said channel members which is spaced from said first channel member.

4. A construction as claimed in claim 3 wherein said slot means comprises a T-shaped slot integrally formed in said rearward surface of said first pilaster means, and the front side of said first channel member has a complementary shape to said T-shaped slot for sliding insertion therein to couple the channel member to said first pilaster means in an interlocking configuration.

5. A construction as claimed in claim 3 further including third vertical post means wherein said first post means and said third post means define a door opening for a second cubicle therebetween, and said divider panel means defines a first side of said second cubicle, the first pilaster means comprising a run pilaster and is symmetrical about a central vertical plane extending from the forward surface to the rearward surface.

6. A construction as claimed in claim 3 wherein the pilaster means has an overall thickness which is selected wider than the dimension of the channel member opening, and includes a vertically extending narrow edge portion having a thickness less than the overall thickness of the pilaster means, and which is sized to permit its insertion in the opening of a channel member.

7. A construction as claimed in claim 5 wherein the pilaster means has an overall thickness which is selected wider than the dimension of the channel member opening, and includes along each vertical edge a vertically extending narrower edge portion, each narrower edge portion having a thickness which is less than the overall thickness of the pilaster means, and being sized to permit its insertion into the opening of a channel member.

8. A construction as claimed in claim 1 wherein said pilaster means includes a removable panel insert and vertically extending slide-way means for receiving the panel insert therein, the slide-way means defining a front opening in a forward surface of the pilaster means wherein on insertion of said panel insert into said slide-way means, said panel insert is positioned rearward of said front opening so that portions of the panel insert are visible therethrough.

9. A construction as claimed in claim 3 wherein said pilaster means includes a removable panel insert and vertically extending slide-way means for receiving the panel insert therein, the slide-way means defining a front opening in the forward surface of the pilaster means wherein on insertion of said panel insert into said slide-way means, said panel insert is positioned rearward of said front opening so that portions of the panel insert are visible therethrough.

10. A construction as claimed in claim 7 wherein said pilaster means further includes a removable panel insert and slide-way means for slidably receiving the panel insert therein, the slide-way means defining an elongate front opening in the forward surface of the pilaster means extending the vertical length of the pilaster means, wherein when the panel insert is inserted in the slide-way means, it is retained thereby in a position immediately rearward of said front opening so that portions of the panel insert are visible therethrough.

11. A construction as claimed in claim 8 wherein said slide-way means comprises a web member which in horizontal cross-section has an overall C-shape, and has dimensions selected to engage rear, side and front portions of said panel insert to maintain its positioning therein.

12. A construction as claimed in claim 11 wherein said web member comprises extruded aluminum.

13. A construction as claimed in claim 9 wherein said side-way means comprises a web member which in horizontal cross-section has an overall C-shape and defines said rearward and forward surfaces, the dimensions of said C-shape selected to engage portions of said panel insert to maintain said panel insert secured in position rearward of said front opening.

14. A construction as claimed in claim 10 wherein said slide-way means comprises a web member which in horizontal cross-section has a generally rectangular C-shape and defines said forward and rearward surfaces and said narrower edge portions, the web member and panel insert having relative dimensions whereby said panel insert is engaged by each of said forward and rearward surfaces and said narrower edge portions to maintain said panel insert in position rearward of said front opening.

15. A construction as claimed in claim 14 wherein said web member comprises extruded aluminum.

16. A construction as claimed in claim 6 wherein said door panel is hingely connected in said door opening along a vertical first door edge, and said hinge means includes a first U-shaped channel means for coupling over said first door edge and a second U-shaped channel means for coupling to said narrow edge portion of said first pilaster means.

17. A cubicle construction as claimed in claim 3 wherein said first and second post means extend upwardly a distance above said door means, and further including elongated headrail means for structurally engaging the first and second post means.

18. A partition structure as claimed in claim 3 further including floor mounting means for securing said first vertical post means to part of a floor, said first channel member coupled to the floor mounting means and extending vertically therefrom, with said second support channel being secured in position with the front side of the second channel member in juxtaposition with a wall.

19. A modular partition structure comprising;

at least one planar divider panel, each panel having generally parallel spaced vertical panel edges, at least one vertical pilaster member having forward and rearward facing vertical surfaces, a pair of vertically extending side portions joining the forward and rearward surfaces, and a T-shaped slot integrally formed in the rearward surface, a plurality of channel members each being elongated along a longitudinal axis and in cross-section through said axis having a generally square C-shape with parallel spaced front and rear sides, the front side having a complementary shape to said T-shaped slot for sliding insertion therein and the rear side defining an opening therethrough extending the length of the channel member parallel to said axis, the channel member opening sized to receive the vertical edges of a divider panel therein, the T-shaped slot and front side of the channel members having dimensions selected to permit longitudinal sliding of the front side of an associated channel member in the slot while fixedly coupling the associated channel member to the pilaster against removal laterally therefrom, a first one of said channel members being coupled to an associated first pilaster member with its front side inserted in the first pilaster slot, a second one of said channel members secured to a wall in a position spaced from said first channel member, and a first one of said divider panels defining a first partition wall being coupled in an upright position with a first one of the panel edges concealed within said first channel member opening, and the second other one of the panel edges concealed second channel member opening.

20. A structure as claimed in claim 19 further including a second vertical pilaster member spaced from said first pilaster member and defining a passageway therebetween, a third one of said channel members coupled to the second pilaster member with its front side inserted in the second pilaster member slot, a fourth one of said channel members secured to said wall in a position spaced from said third channel member, and a second one of said divider panels defining a second partition wall being coupled in an upright position with its first panel edge concealed within the third channel member opening and its second other panel edge concealed within the fourth channel member opening.

21. A structure as claimed in claim 19 wherein said at least one pilaster member includes a web member which in horizontal cross-section has a generally C-shape defining a front opening in said forward facing surface, and a removable panel insert member configured for insertion in said web member, said panel insert having a decorative finish applied thereto and being secured in position rearward of said front opening so that portions of said decorative finish are visible through said front opening.

22. A structure as claimed in claim 20 further including door means pivotally disposed in said passageway, said door means including a planar door panel and hinge means for hingely connecting a vertical edge of the door panel to a first side portion of either one of the first and second pilaster members, the hinge means including a rectangular U-shaped channel member for coupling over and substantially concealing the vertical edge of the door panel.

* * * * *